US010386769B2

(12) United States Patent
Nohara

(10) Patent No.: US 10,386,769 B2
(45) Date of Patent: Aug. 20, 2019

(54) IMAGE FORMING DEVICE

(71) Applicant: KYOCERA Document Solutions Inc., Osaka-shi (JP)

(72) Inventor: Yuta Nohara, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 16/214,288

(22) Filed: Dec. 10, 2018

(65) Prior Publication Data

US 2019/0187602 A1 Jun. 20, 2019

(30) Foreign Application Priority Data

Dec. 18, 2017 (JP) ..... 2017-241500

(51) Int. Cl.
*G03G 15/08* (2006.01)
*G03G 15/00* (2006.01)
*G03G 21/16* (2006.01)

(52) U.S. Cl.
CPC ..... *G03G 15/556* (2013.01); *G03G 15/0856* (2013.01); *G03G 15/0867* (2013.01); *G03G 21/1619* (2013.01); *G03G 21/1623* (2013.01)

(58) Field of Classification Search
CPC ..... G03G 15/556; G03G 15/0856; G03G 15/0865; G03G 15/0867; G03G 15/0868; G03G 15/087; G03G 21/1619; G03G 21/1623
See application file for complete search history.

(56) References Cited

U.S. PATENT DOCUMENTS 8,437,648 B2 * 5/2013 Tachibana ..... G03G 15/553 399/13
10,042,286 B2 * 8/2018 Okuda ..... G03G 21/1676
2010/0329704 A1 12/2010 Tachibana

FOREIGN PATENT DOCUMENTS

JP 2005-91462 4/2005
JP 2011-8142 1/2011

* cited by examiner

*Primary Examiner* — Hoang X Ngo
(74) *Attorney, Agent, or Firm* — Gerald E. Hespos; Michael J. Porco; Matthew T. Hespos

(57) ABSTRACT

A drive transmission unit provided in an image forming device includes a first drive transmission portion and a second drive transmission portion. The first drive transmission portion transmits a rotation drive force of a motor rotating in a first rotation direction to a toner container, to transport a toner housed in the toner container in a predetermined direction, and regulates transmission of a rotation drive force of the motor rotating in a second rotation direction to the toner container. The second drive transmission portion transmits the rotation drive force of the motor rotating in the second rotation direction to the container cover, to cause the container cover to switch from a closed state to an open state, and regulates transmission of the rotation drive force of the motor rotating in the first rotation direction to the container cover.

11 Claims, 18 Drawing Sheets

IMAGE FORMING DEVICE

The present application claims priority from Japanese Patent Application No. 2017-241500 filed on Dec. 18, 2017, disclosure of which is all incorporated herein.

BACKGROUND

The present disclosure relates to an image forming device which forms an image on a sheet.

Conventional image forming devices adopting an electrophotography system, such as a printer, a copying machine, and the like, include a photosensitive drum which carries an electrostatic latent image, a developing device which supplies a toner to the photosensitive drum to make an electrostatic latent image appear as a toner image, and a transfer device which transfers a toner image to a sheet from the photosensitive drum.

Image forming devices each equipped with a plurality of developing devices according to color toners of respective colors are known, in which a plurality of toner containers are arranged for supplying the respective developing devices with a replenishment toner. In these techniques, a plurality of openable container covers are provided on a front face portion of a device main body. When the container cover is opened, the toner containers are exposed to the outside to enable replacement of the toner containers.

SUMMARY

An image forming device according to one aspect of the present disclosure includes: a device main body; an image forming portion which forms a toner image; and a transfer portion which transfers the toner image to a sheet. The image forming portion includes at least one photosensitive drum rotated around a predetermined axis and having a circumference surface which allows an electrostatic latent image to be formed thereon and carrying a toner image according to the electrostatic latent image; at least one developing device which supplies a toner to the photosensitive drum to make the electrostatic latent image appear as the toner image; at least one toner container which houses a toner to be replenished to the developing device; and at least one drive portion. The device main body includes an openable main body cover; and at least one container cover which is exposed to an outside of the device main body by opening of the main body cover and which is capable of switching between an open state of allowing attachment/detachment of the toner container to/from the device main body and a closed state of preventing removal of the toner container from the device main body. The at least one drive portion has a motor rotatable in a first rotation direction and a second rotation direction reverse to the first rotation direction, and a drive transmission unit including a first drive transmission portion and a second drive transmission portion. The first drive transmission portion transmits a rotation drive force of the motor rotating in the first rotation direction to the toner container, to transport the toner housed in the toner container in a predetermined direction, and regulates transmission of a rotation drive force of the motor rotating in the second rotation direction to the toner container. The second drive transmission portion transmits the rotation drive force of the motor rotating in the second rotation direction to the container cover, to cause the container cover to switch from the closed state to the open state, and regulates transmission of the rotation drive force of the motor rotating in the first rotation direction to the container cover.

DETAILED DESCRIPTION

In the following, an image forming device 10 according to a first embodiment of the present disclosure will be described in detail with reference to the drawings. In the present embodiment, a tandem color printer will be illustrated as one example of the image forming device. The image forming device may be, for example, a copying machine, a facsimile machine, a multifunctional machine combining the same, or the like. The image forming device may be also a printer, a copying machine, or the like which forms a unicolor (monochrome) image.

Figure 1:
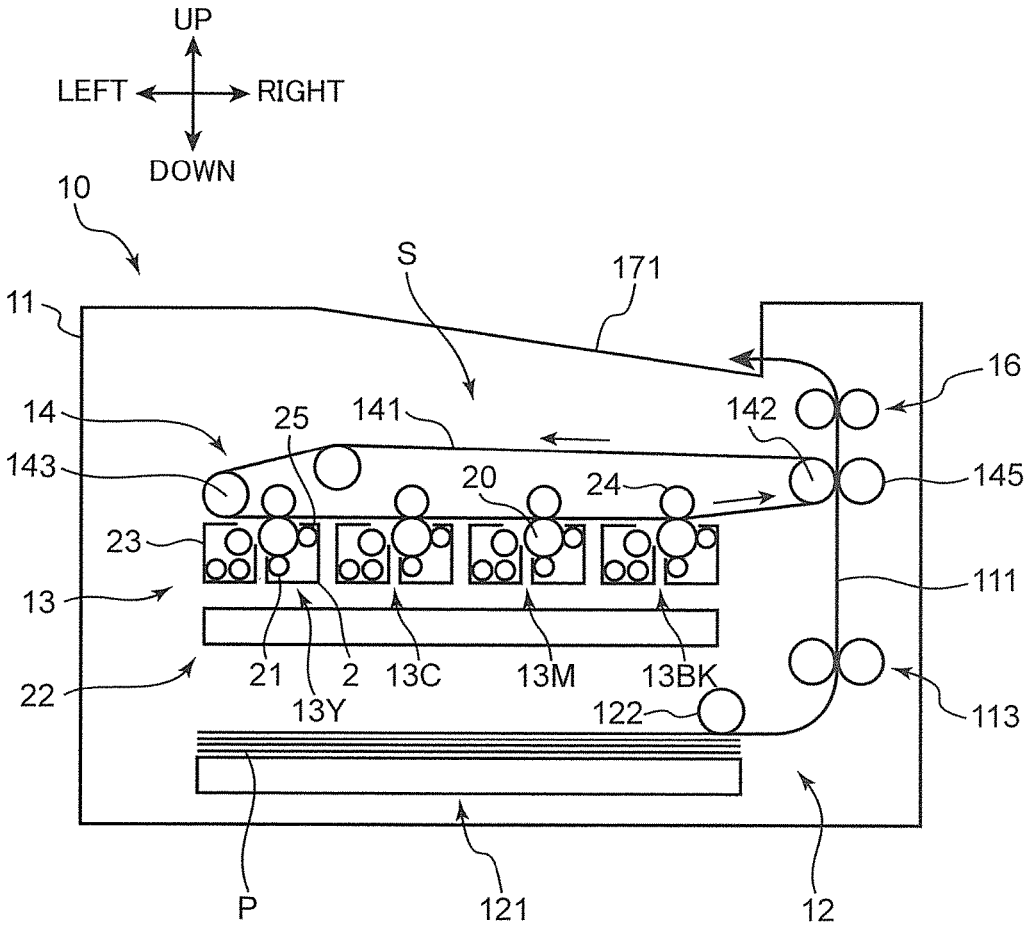
FIG. 1 is a sectional view showing an internal structure of an image forming device according to a first embodiment of the present disclosure.

FIG. 1 is a sectional view showing an internal structure of the image forming device 10. The image forming device 10 includes a device main body 11 having a box-shape casing structure. In the device main body 11, there are internally provided a sheet feeding portion 12 which feeds a sheet P, an image forming portion 13 which forms a toner image to be transferred to the sheet P fed by the sheet feeding portion 12, an intermediate transfer unit 14 to which the toner image is primarily transferred, a secondary transfer roller 145, and a fixing portion 16 which executes processing of fixing, to the sheet P, a toner image which is formed on the sheet P and yet to be fixed. Further, in an upper part of the device main body 11, a sheet ejection portion 171 is provided which ejects the sheet P subjected to the fixing processing by the fixing portion 16.

In the device main body 11, a sheet transport path 111 extending in an up-down direction is further formed at the right side of the image forming portion 13. The sheet transport path 111 is provided with a transport roller pair for transporting the sheet P at an appropriate position. Also in the sheet transport path 111, a resist roller pair 113 for conducting skew correction of the sheet P, as well as sending the sheet P to a secondary transfer nip portion to be described later at predetermined timing is provided on the upstream side of the nip portion. The sheet transport path 111 is a transport path for transporting the sheet P from the sheet feeding portion 12 to the sheet ejection portion 171 via the image forming portion 13 (the secondary transfer nip portion) and the fixing portion 16.

The sheet feeding portion 12 includes a sheet feeding tray 121 and a pick-up roller 122. The sheet feeding tray 121 is detachably attached at a lower position of the device main body 11 to store a bundle of sheets including a plurality of stacked sheets P. The pick-up roller 122 feeds an uppermost sheet P of the bundle of the sheets stored in the sheet feeding tray 121 one by one.

The image forming portion 13 forms a toner image to be transferred to the sheet P and includes a plurality of image forming units which form toner images of different colors. As the image forming unit, the present embodiment is provided with a yellow unit 13Y which uses a yellow (Y) color toner, a cyan unit 13C which uses a cyan (C) color toner, a magenta unit 13M which uses a magenta (M) color toner, and a black unit 13BK which uses a black (Bk) color toner, the units being sequentially disposed according to a plurality of color toners from an upstream side to a downstream side in a rotation direction of an intermediate transfer belt 141 to be described later (from left to right in FIG. 1). Each unit includes a photosensitive drum 20, a charging device 21, a developing device 23, and a cleaning device 25 arranged on the periphery of the photosensitive drum 20. An exposure device 22 commonly used by the respective units is arranged below the image forming unit.

Figure 2:
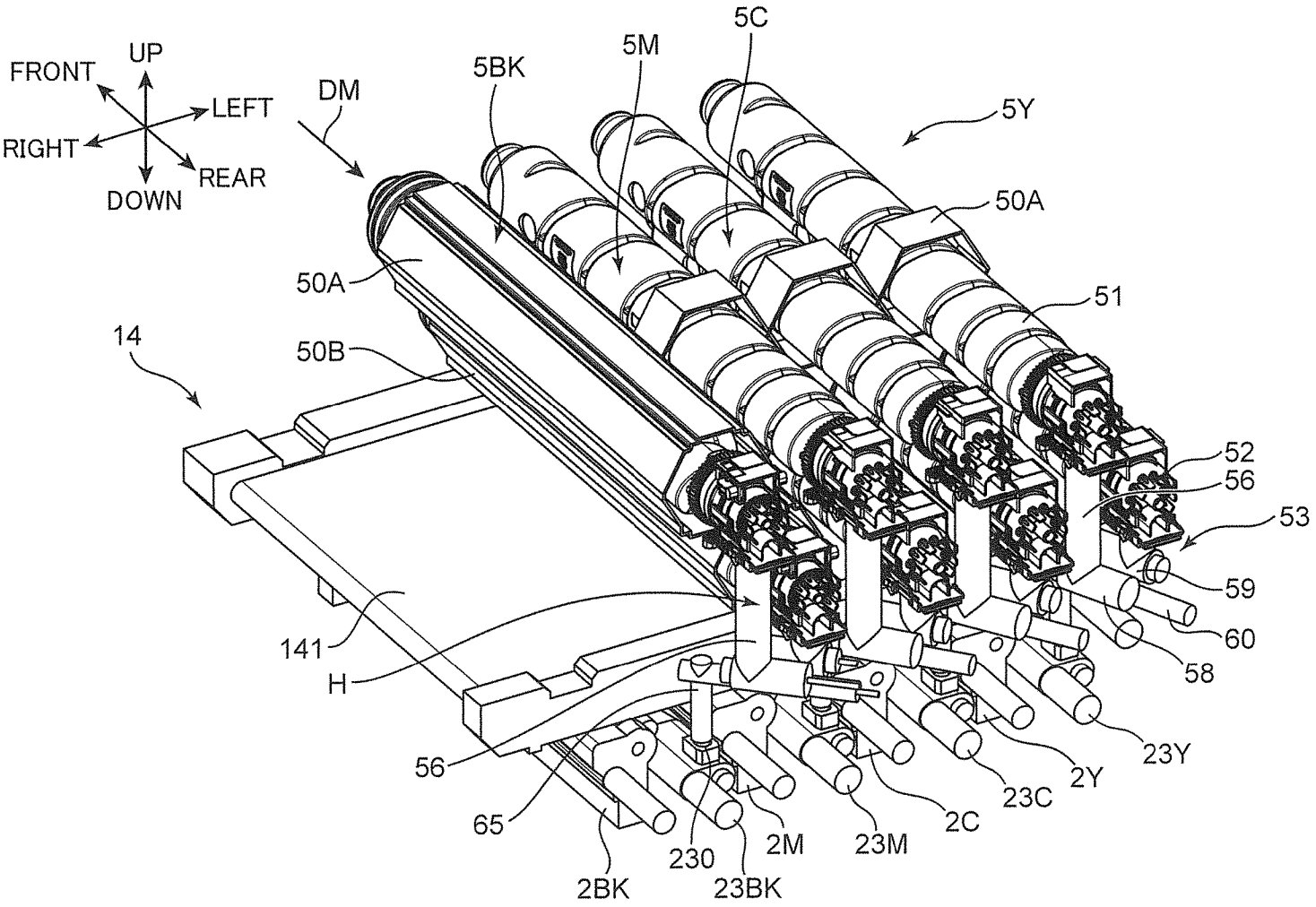
FIG. 2 is a perspective view of an image forming portion of the image forming device according to the first embodiment of the present disclosure.

The photosensitive drum 20 is rotatably driven around a predetermined axis extending in a front-rear direction, and allows an electrostatic latent image to be formed on a circumference surface thereof and also carries a toner image thereon. The charging device 21 uniformly charges a surface of the photosensitive drum 20. The exposure device 22 has various kinds of optical devices such as a light source, a polygon mirror, a reflecting mirror, and a deflecting mirror, and irradiates the uniformly charged circumference surface of the photosensitive drum 20 with light modified based on image data to form an electrostatic latent image. The cleaning device 25 cleans the circumference surface of the photosensitive drum 20 after transfer of a toner image. In the present embodiment, the photosensitive drum 20, the charging device 21, and the cleaning device 25 integrally configure a drum unit 2 (2Y, 2C, 2M, 2BK) (FIG. 1, FIG. 2).

The developing device 23 supplies a toner to the circumference surface of the photosensitive drum 20 for developing (making appear) an electrostatic latent image formed on the photosensitive drum 20. The developing device 23 houses a magnetic one-component toner as a developer. In the present embodiment, the toner has property of being charged to have positive polarity. In other embodiment, the developing device 23 may adopt other developing method such as a method using a two-component developer composed of a toner and a carrier, or a nonmagnetic one-component method. The developing device 23 has a toner replenishing port 230 which internally accepts a toner (see FIG. 2).

The intermediate transfer unit 14 is arranged above the image forming portion 13. The intermediate transfer unit 14 includes the intermediate transfer belt 141, a drive roller 142, a follower roller 143, and a primary transfer roller 24.

The intermediate transfer belt 141 is an endless belt-shaped rotary body which extends between the drive roller 142 and the follower roller 143 so as to have a circumference surface side thereof come into contact with the circumference surface of each photosensitive drum 20. The intermediate transfer belt 141 is circularly driven in one direction to carry on a surface thereof a toner image transferred from the photosensitive drum 20.

The drive roller 142 extends the intermediate transfer belt 141 at a right end side of the intermediate transfer unit 14 to circularly drive the intermediate transfer belt 141. The drive roller 142 is formed of a metal roller. The follower roller 143 extends the intermediate transfer belt 141 at a left end side of the intermediate transfer unit 14. The follower roller 143 imparts tension to the intermediate transfer belt 141.

The primary transfer roller 24 forms a primary transfer nip portion with the photosensitive drum 20, with the intermediate transfer belt 141 provided therebetween, so as to primarily transfer a toner image on the photosensitive drum 20 to the intermediate transfer belt 141. The primary transfer roller 24 is arranged to be opposed to the photosensitive drum 20 of each color.

The secondary transfer roller 145 is arranged to be opposed to the drive roller 142 with the intermediate transfer belt 141 provided therebetween. The secondary transfer roller 145 contacts a circumference surface of the intermediate transfer belt 141 by pressure to form the secondary transfer nip portion. A toner image primarily transferred to the intermediate transfer belt 141 is secondarily transferred, in the secondary transfer nip portion, to the sheet P supplied from the sheet feeding portion 12. The intermediate transfer unit 14 and the secondary transfer roller 145 of the present embodiment configure a transfer portion of the present disclosure. The transfer portion transfers a toner image formed in the image forming portion 13 to the sheet P from the photosensitive drum 20.

The sheet P supplied to the fixing portion 16 passes through a fixing nip portion so as to be thermally pressurized. As a result, the toner image transferred to the sheet P by the secondary transfer nip portion is fixed to the sheet P.

The sheet ejection portion 171 is formed by depressing a top portion of the device main body 11. The sheet P subjected to the fixing processing is ejected to the sheet ejection tray 171 via the sheet transport path 111 extending from an upper part of the fixing portion 16.

Figure 3:
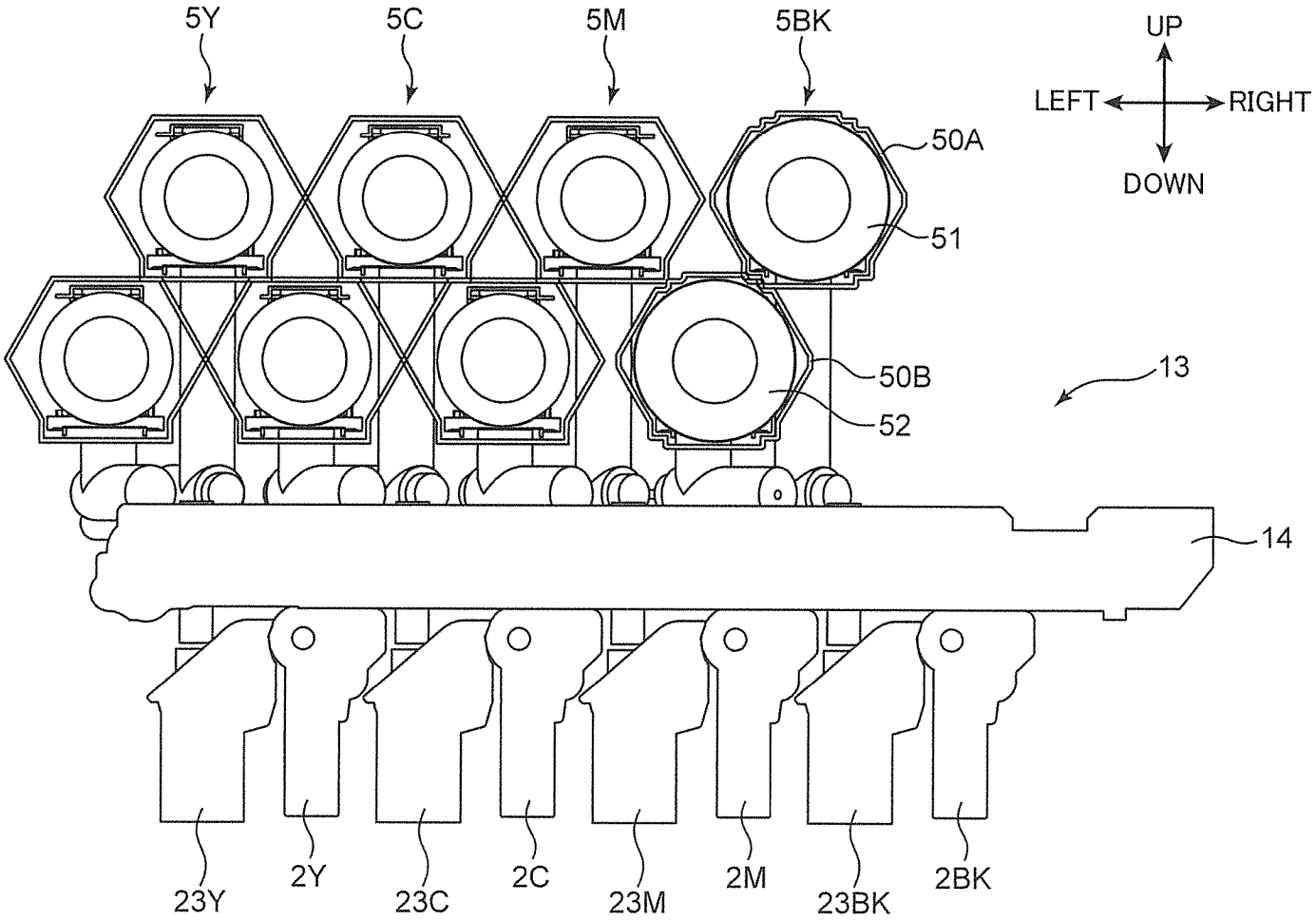
FIG. 3 is a front view of the image forming portion of the image forming device according to the first embodiment of the present disclosure.
Figure 4:
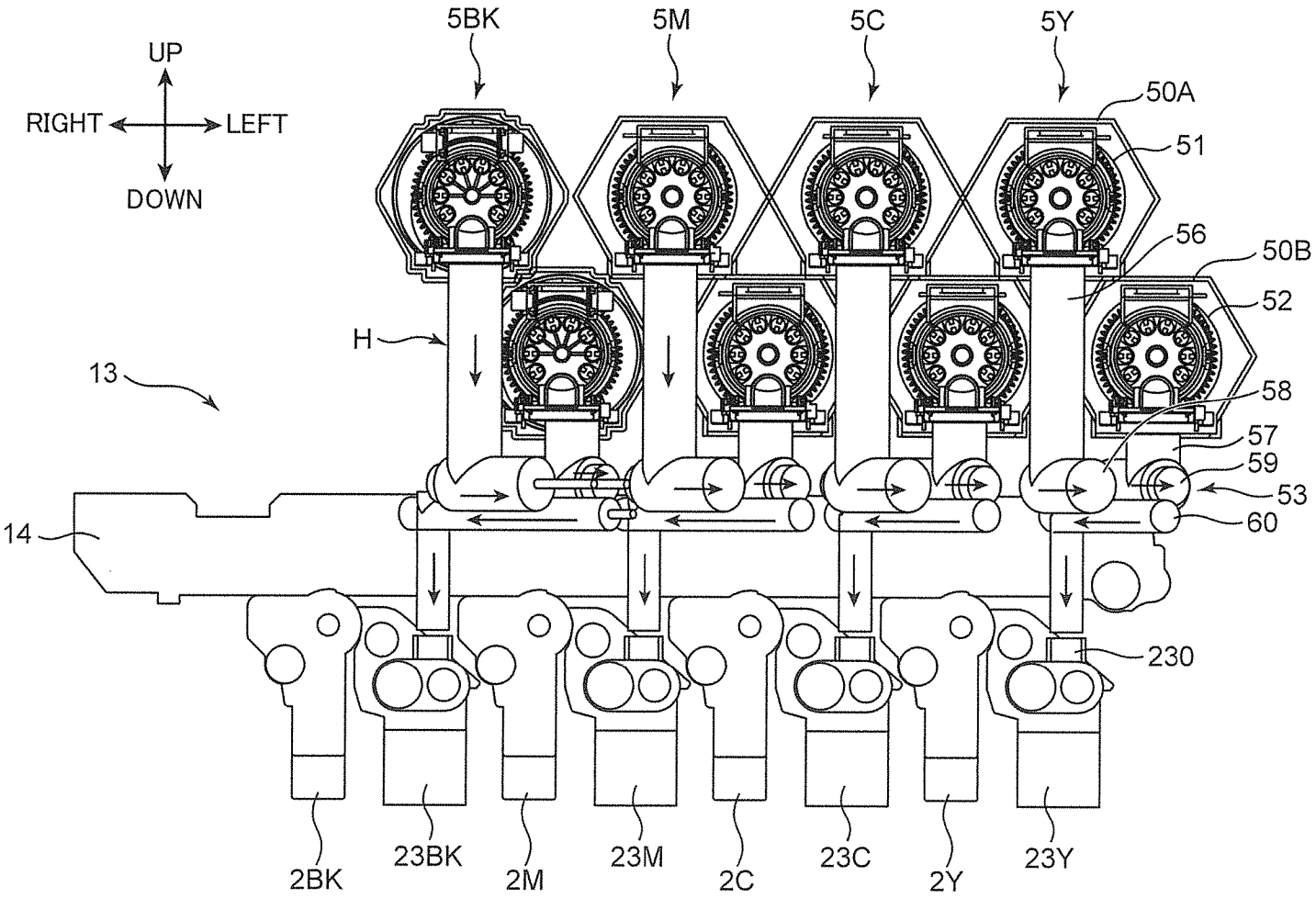
FIG. 4 is a rear view of the image forming portion of the image forming device according to the first embodiment of the present disclosure.
Figure 5:
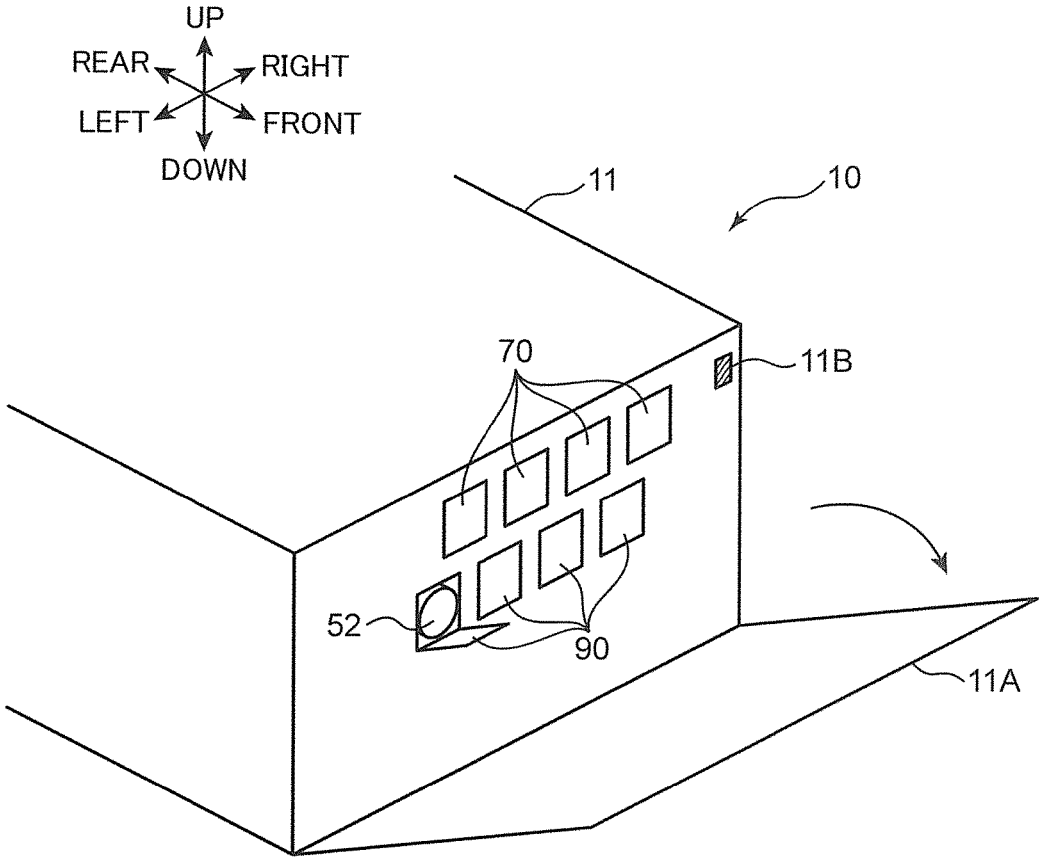
FIG. 5 is a perspective view schematically showing the image forming device according to the first embodiment of the present disclosure in a state where a front cover of a device main body is opened.
Figure 6:
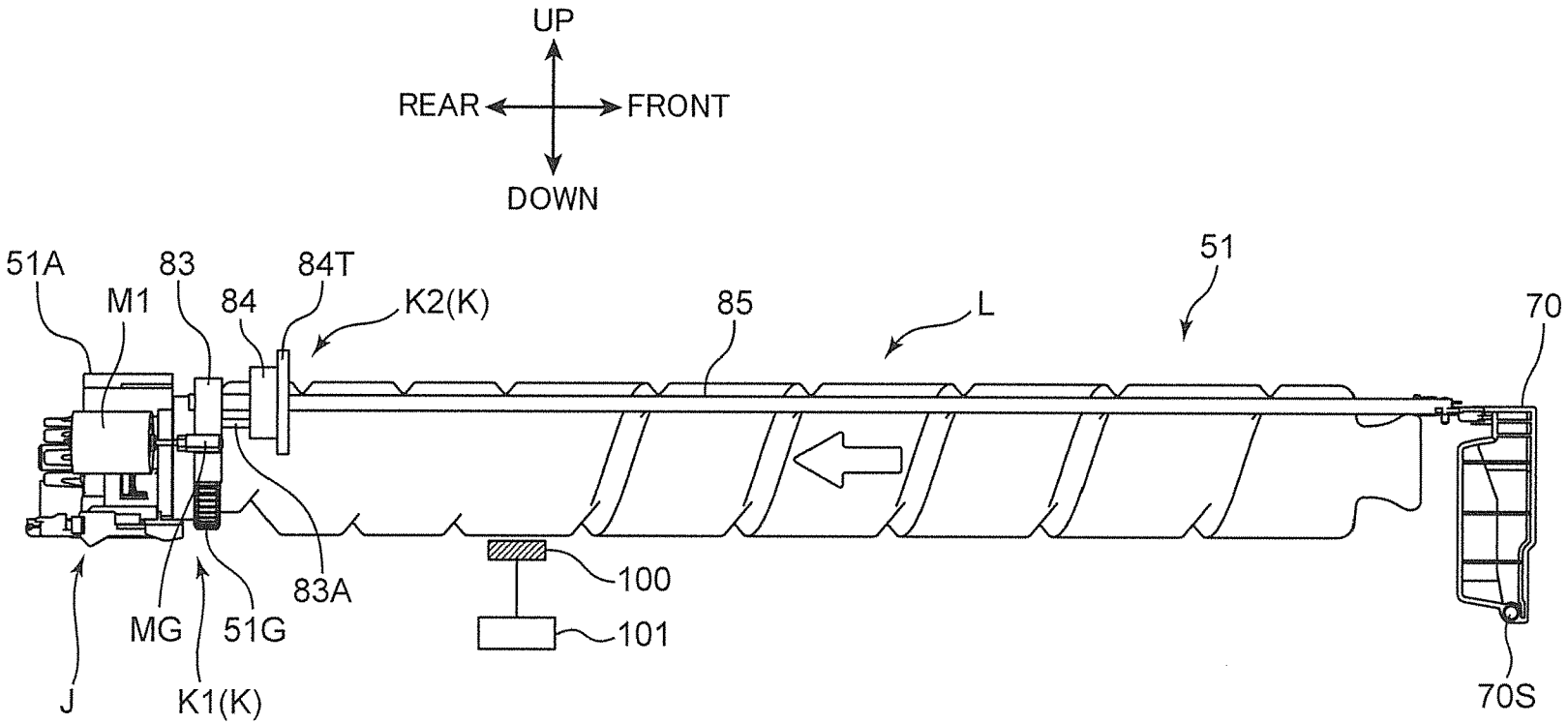
FIG. 6 is a side view of a toner container, a drive portion, and a container cover according to the first embodiment of the present disclosure.
Figure 7:
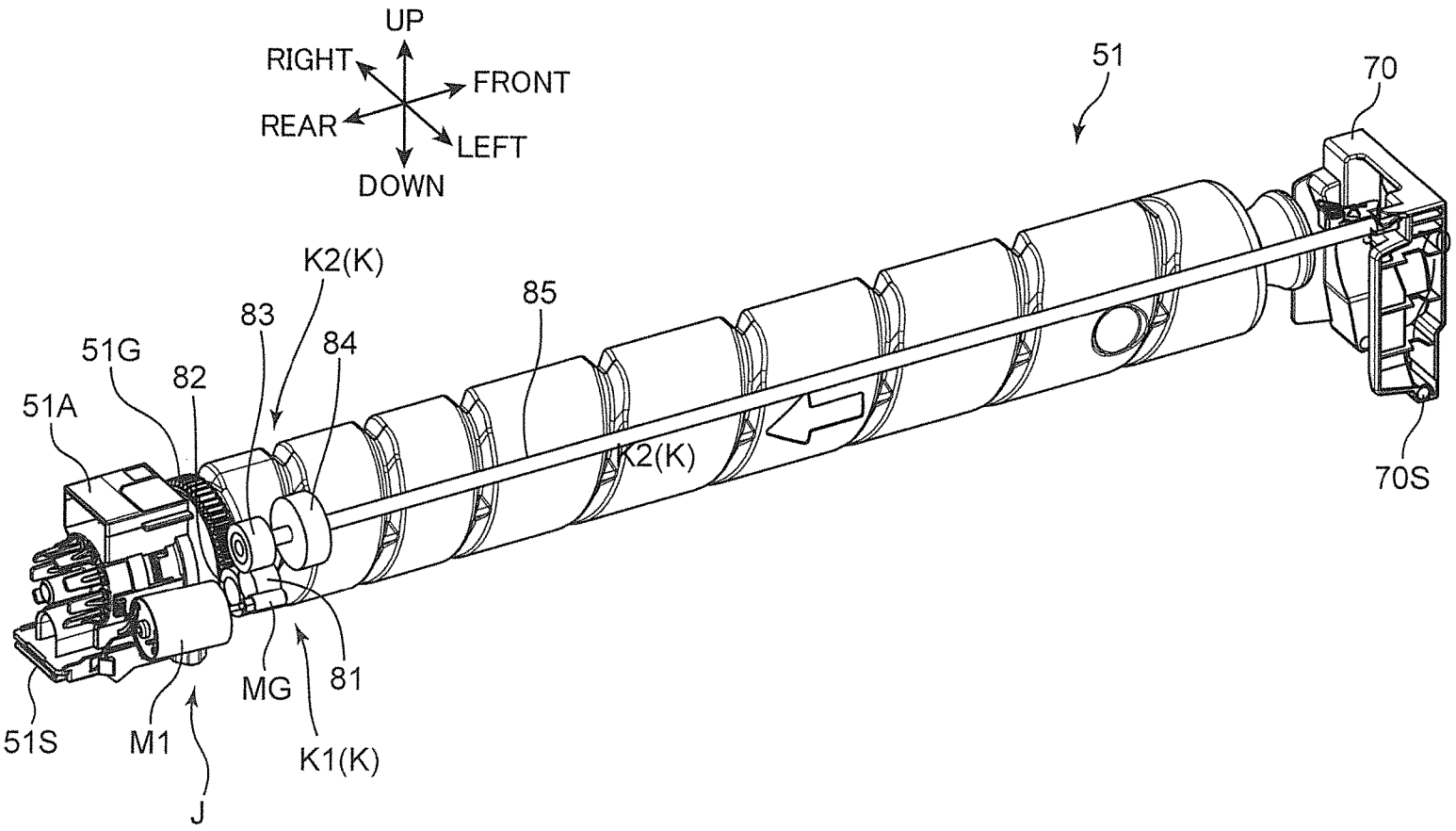
FIG. 7 is a perspective view of the toner container, the drive portion, and the container cover according to the first embodiment of the present disclosure.
Figure 8:
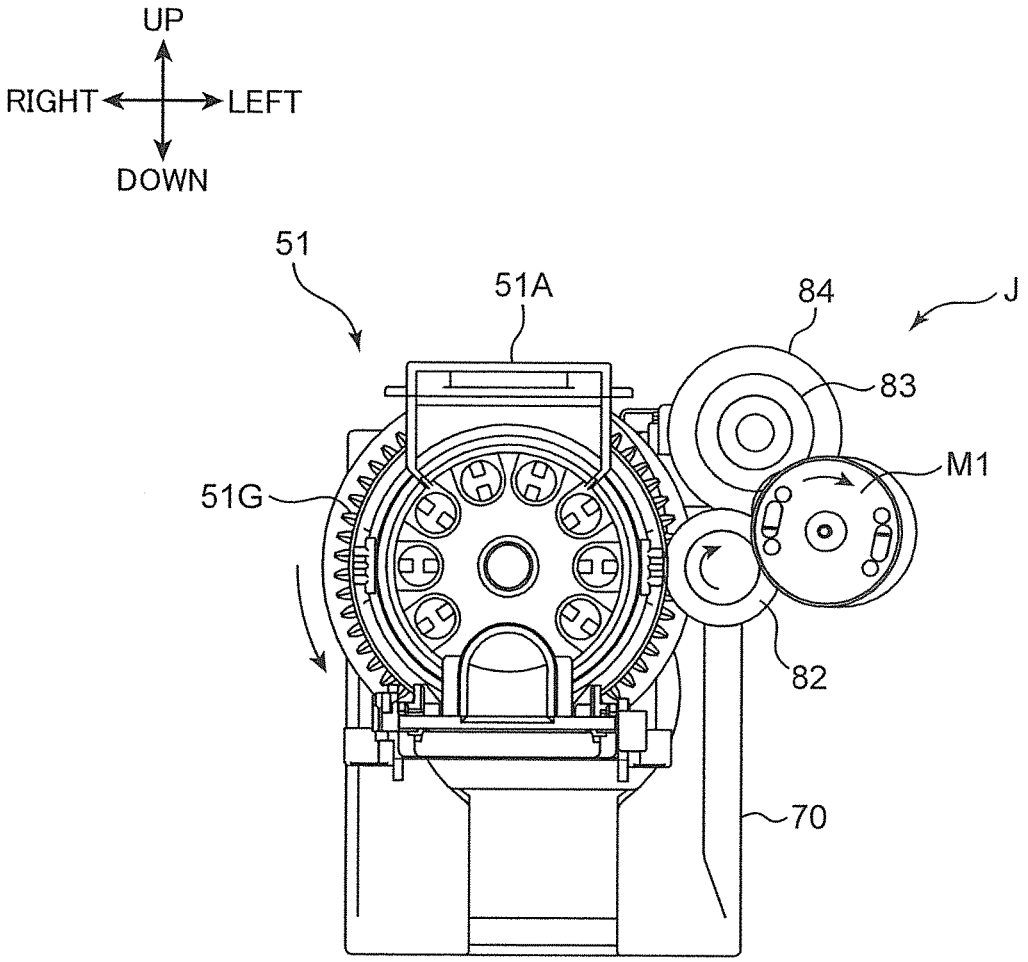
FIG. 8 is a rear view of the toner container, the drive portion, and the container cover according to the first embodiment of the present disclosure.

FIG. 2 to FIG. 4 are a perspective view, a front view, and a rear view of the image forming portion 13 of the image forming device 10 according to the present embodiment. FIG. 5 is a perspective view schematically showing the image forming device 10 according to the present embodiment in a state where a front cover 11A of the device main body 11 is opened. FIG. 6 to FIG. 8 are a side view, a perspective view, and a rear view of an upper toner container 51, a drive portion J, and an upper container cover 70 according to the present embodiment.

With reference to FIG. 2 to FIG. 4, the image forming device 10 further includes a toner replenishing unit 5. The toner replenishing unit 5 is arranged above the developing device 23 (23BK, 23M, 23C, 23Y) of each color to replenish the developing device 23 with the toner through the toner replenishing port 230. As shown in FIG. 2, the toner replenishing units 5 of the respective colors (5BK, 5M, 5C, 5Y) are horizontally arranged adjacent to each other in the present embodiment.

The toner replenishing unit 5 of each color has the upper toner container 51 (a toner container, a first toner container), a lower toner container 52 (a toner container, a second toner container), an upper housing 50A, a lower housing 50B, and a toner transport unit 53.

The upper toner container 51 and the lower toner container 52 each have a cylindrical shape extending along an axial direction of the photosensitive drum 20, and store a toner therein and is capable of discharging a toner. The direction in which the upper toner container 51 and the lower toner container 52 extend may be a direction different from the axial direction of the photosensitive drum 20. The upper toner container 51 and the lower toner container 52 are attached to the device main body 11 of the image forming device 10 along an attachment direction (an arrow DM in FIG. 2) along the axial direction of the photosensitive drum 20. In the present embodiment, the upper toner container 51 and the lower toner container 52 each have the cylindrical shape and have an outer circumference surface on which a spiral groove extending spirally along an axial direction is formed (FIG. 2, FIG. 6, and FIG. 7). The spiral groove forms a spiral protrusion portion which protrudes into an inner space of each of the upper toner container 51 and the lower toner container 52. Then, as will be described later, rotation of the upper toner container 51 and the lower toner container 52 causes an inside toner to be transported toward the rear side by the spiral protrusion portion. The upper toner container 51 has a fixed portion 51A and a first container gear 51G (FIG. 6). The fixed portion 51A engages with the toner transport unit 53 to transmit a toner in the upper toner container 51 to the toner transport unit 53. The fixed portion 51A does not rotate, and a part of the upper toner container 51 more ahead of the fixed portion 51A is configured to be rotatable relative to the fixed portion 51A. The first container gear 51G is a gear fixed to the outer circumference part of the upper toner container 51 at a position forward of the fixed portion 51A. Transmission of a rotation force to the first container gear 51G causes the forward portion of the upper toner container 51 to rotate.

Figure 12:
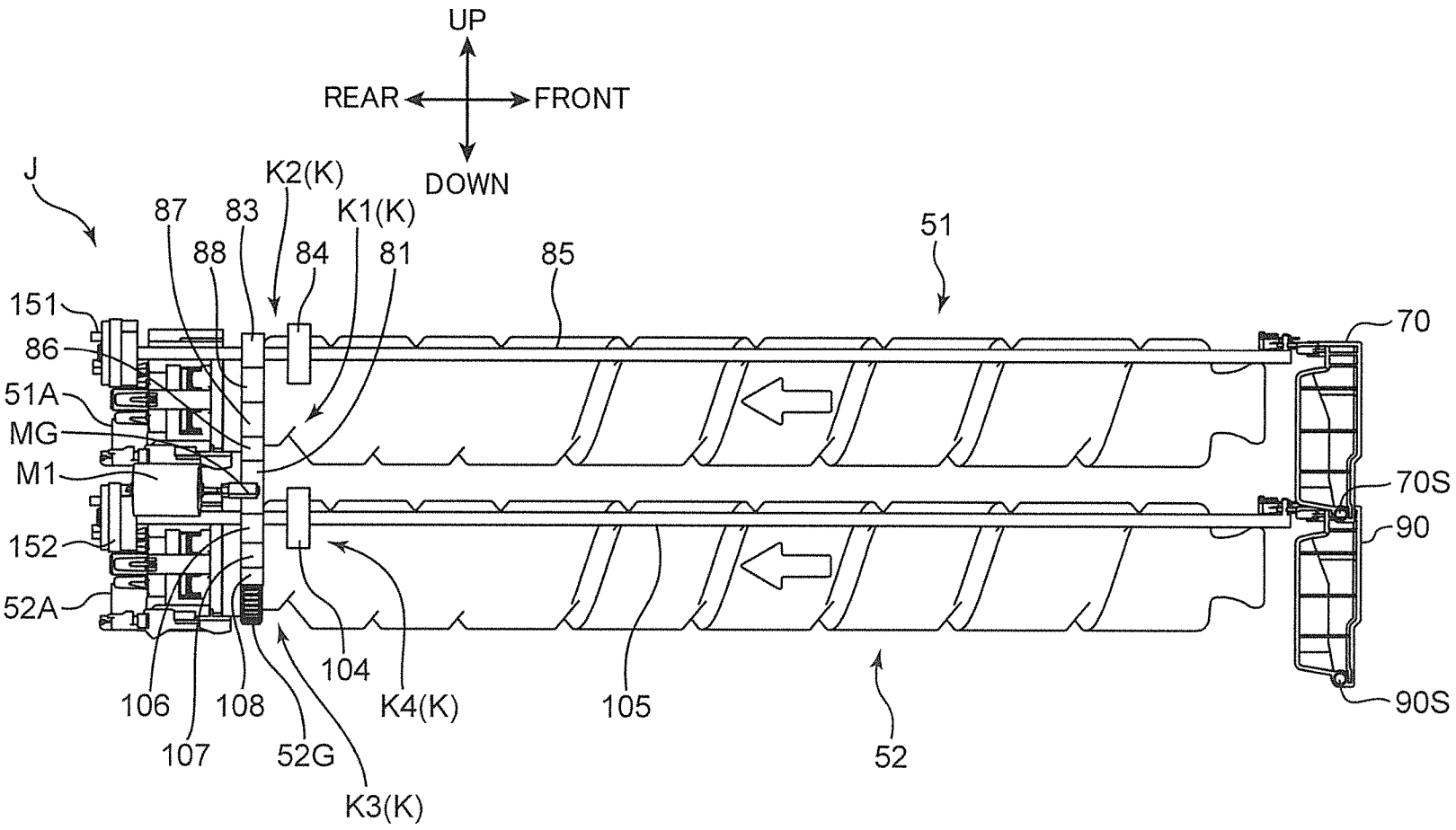
FIG. 12 is a side view of a toner container, a drive portion, and a container cover according to a second embodiment of the present disclosure.

The lower toner container 52 similarly has a fixed portion 52A and a second container gear 52G (see FIG. 12). The fixed portion 52A engages with the toner transport unit 53 to transmit a toner in the lower toner container 52 to the toner transport unit 53. The fixed portion 52A does not rotate, and a part of the lower toner container 52 more ahead of the fixed portion 52A is configured to be rotatable relative to the fixed portion 52A. The second container gear 52G is a gear fixed to the outer circumference part of the lower toner container 52 at a position forward of the fixed portion 52A. Transmission of a rotation force to the second container gear 52G causes the forward portion of the lower toner container 52 to rotate.

The upper toner container 51 has a first toner discharge port (not shown) formed at a front end side (the fixed portion 51A) in the direction in which the upper housing 50A is attached, and the lower toner container 52 has a second toner discharge port (not shown) formed at a front end side (the fixed portion 52A) in the direction in which the lower housing 50B is attached. A toner is discharged from these toner discharge ports. The upper toner container 51 and the lower toner container 52 include shutters 51S and 52S (FIG. 7 and FIG. 13) which block the toner discharge ports, respectively. When the upper toner container 51 and the lower toner container 52 are attached to the upper housing 50A and the lower housing 50B, these shutters are slid to move and open the respective toner discharge ports. Also in the present embodiment, the upper toner container 51 and the lower toner container 52 are toner containers having the same shape. In other words, the toner container of each color applied to the image forming device 10 is attachable to either of the upper housing 50A and the lower housing 50B in the toner replenishing unit 5 of the corresponding color. The upper toner container 51 and the lower toner container 52 are arranged in a container space S of the device main body 11 shown in FIG. 1.

The upper housings 50A are arranged above the developing device 23 so as to be spaced from each other in the device main body 11 and each allow the upper toner container 51 to be attached inside the upper housing 50A along an attachment direction DM, as well as accepting the upper toner container 51. The lower housings 50B are arranged above the developing device 23 and below the upper housing 50A in the device main body 11 and each allow the lower toner container 52 to be attached inside the lower housing 50B along the attachment direction DM, as well as accepting the lower toner container 52. The upper housing 50A and the lower housing 50B may have a shape extending long in the front-rear direction as the housing at the black position BK shown in FIG. 2 or may have a shape arranged to have a predetermined width at the center in the front-rear direction as the housing at the yellow position Y shown in FIG. 2.

With reference to FIG. 2 to FIG. 4, in the present embodiment, the lower housing 50B positions the lower toner container 52 in the device main body such that a front end portion (a rear end portion) of the lower toner container 52 in the attachment direction is arranged at the same position in the attachment direction as a front end portion (a rear end portion) of the upper toner container 51 attached to the upper housing 50A in the attachment direction. Further, the lower housing 50B is arranged at a position above the developing device 23 and below the upper housing 50A, the position being displaced from the upper housing 50A in a horizontal direction (right and left direction) orthogonal to the axial direction of the photosensitive drum 20 in the device main body 11 (FIG. 2 to FIG. 4). As a result, a container stepped portion H is formed in a space below the front end portion of the upper toner container 51 in the attachment direction (the rear end portion of the upper toner container 51), the space being opposed, in the horizontal direction orthogonal to the axial direction of the photosensitive drum 20, to the front end portion of the lower toner container 52 in the attachment direction (FIG. 2 and FIG. 4). Although in each of the drawings, a part of the container stepped portions H are assigned reference codes, the container stepped portions H are formed for the respective colors.

The toner transport unit 53 transports toners discharged from the upper toner container 51 attached to the upper housing 50A and from the lower toner container 52 attached to the lower housing 50B to the developing device 23. As will be described later, a part of the toner transport unit 53 is arranged in the above-described container stepped portion H.

The toner transport unit 53 has a first vertical transport portion 56, a second vertical transport portion 57, a first horizontal transport portion 58, a second horizontal transport portion 59, a toner storage portion 60, and a third vertical transport portion 65.

The first vertical transport portion 56 is a pipe-shaped member arranged at the right side of the rear end portion of the lower toner container 52 and below the fixed portion 51A of the upper toner container 51. In other words, the first vertical transport portion 56 is arranged at the container stepped portion H. The first vertical transport portion 56 is arranged to extend downward from the fixed portion 51A and transports a toner downward. Therefore, when the upper toner container 51 is attached to the device main body 11, the fixed portion 51A and the first vertical transport portion 56 communicate with each other.

The second vertical transport portion 57 is a pipe-shaped member arranged below the fixed portion 52A of the lower toner container 52. The second vertical transport portion 57 is arranged to extend downward from the fixed portion 52A and transports a toner downward. Therefore, when the lower toner container 52 is attached to the device main body 11, the fixed portion 52A and the second vertical transport portion 57 communicate with each other.

The first horizontal transport portion 58 is a horizontally extending pipe-shaped member. The first horizontal transport portion 58 accepts a toner from the first vertical transport portion 56, and also transmits a toner to the toner storage portion 60 while transporting the toner backward and leftward along a horizontal direction.

The second horizontal transport portion 59 is a horizontally extending pipe-shaped member. The second horizontal transport portion 59 accepts a toner from the second vertical transport portion 57, and also transmits a toner to the toner storage portion 60 while transporting the toner backward and leftward along the horizontal direction.

The toner storage portion 60 is a pipe-shaped member. The toner storage portion 60 accepts toners transported by the first vertical transport portion 56 and the second vertical transport portion 57 such that the toners join through the first horizontal transport portion 58 and the second horizontal transport portion 59, and also transports the toners further forward and rightward along the horizontal direction.

The third vertical transport portion 65 is a pipe-shaped member. The third vertical transport portion 65 extends downward from a rear end portion of the toner storage portion 60, and supplies the toner replenishing port 230 of the developing device 23 with a toner. Therefore, the third vertical transport portion 65 communicates with the toner storage portion 60 and the developing device 23. In each of the drawings, for the purpose of description, the positions of the third vertical transport portion 65 and the toner replenishing port 230 are slightly displaced from each other.

Transport screws (not shown) which rotate to horizontally transport a toner are arranged in the first horizontal transport portion 58, the second horizontal transport portion 59, and the toner storage portion 60, respectively. In a case where the toner storage portion 60 is filled with a toner, an amount of a toner to be replenished to the developing device 23 is determined according to a rotation amount of the transport screw. Also, while in the present embodiment, such a transport member as described above is not arranged in the first vertical transport portion 56, the second vertical transport portion 57, and the third vertical transport portion 65, a stirring member which rotates or moves up and down for preventing aggregation of a toner in the transport portion may be arranged in other embodiment.

With reference to FIG. 5, the device main body 11 includes the front cover 11A (main body cover) and a cover detection portion 11B. The front cover 11A defines the front face portion of the device main body 11 and is configured to be operable as shown in FIG. 5. The cover detection portion 11B is a sensor which detects that the front cover 11A is opened, one example of which is formed with a PI sensor. Further, the device main body 11 includes four (a plurality of) upper container covers 70 (container covers) and four (a plurality of) lower container covers 90 (container covers). The upper container cover 70 and the lower container cover 90 have the same structure. As shown in FIG. 5, each of the upper container covers 70 and the lower container covers 90 are exposed to the outside of the device main body 11 by opening the front cover 11A. The upper container cover 70 and the lower container cover 90 are configured to be openable and to be capable of switching between an open state of allowing attachment/detachment of the upper toner container 51 or the lower toner container 52 to/from the device main body 11 and a closed state of preventing removal of the upper toner container 51 or the lower toner container 52 from the device main body 11. At this time, the upper container cover 70 and the lower container cover 90 are opened/closed with a cover supporting portion 70S (FIG. 6) and a cover supporting portion 90S (FIG. 12) arranged at lower end portions of the covers and extending in the right and left direction as supporting points. In the cover supporting portion 70S and the cover supporting portion 90S, coil springs (not shown) are arranged. The coil springs have urging force which urges the upper container cover 70 and the lower container cover 90 in a direction in which the covers are opened.

The image forming device 10 further includes a plurality of drive portions J. In the present embodiment, a total of eight drive portions J are provided according to the four upper toner containers 51 and the four lower toner containers 52. In FIG. 6 to FIG. 8, a structure of the drive portion J will be described in the following with the drive portion J provided for one upper toner container 51 and one upper container cover 70 as an example. The drive portion J provided for the lower toner container 52 and the lower container cover 90 has the same structure.

The drive portion J has a motor M1 and a drive transmission unit K. The motor M1 is a single motor provided corresponding to each upper toner container 51 (lower toner container 52). The motor M1 is capable of rotating in a first rotation direction (forward rotation) and a second rotation direction (reverse rotation) reverse to the first rotation direction. As shown in FIG. 6 and FIG. 7, the motor M1 is arranged to be opposed to one end side (the rear end portion) of the upper toner container 51 in the axial direction.

The drive transmission unit K has a function of transmitting a rotation drive force of the motor M1 to the upper toner container 51 (the lower toner container 52) or to the upper container cover 70 (the lower container cover 90). Specifically, the drive transmission unit K has a first drive transmission portion K1 and a second drive transmission portion K2. The first drive transmission portion K1 transmits a rotation drive force of the motor M1 rotating in the first rotation direction to the upper toner container 51, to transport a toner housed in the upper toner container 51 in a predetermined direction (toward the fixed portion 51A and the upper shutter 51S), and regulates transmission of a rotation drive force of the motor M1 rotating in the second rotation direction to the toner container 51. On the other hand, the second drive transmission portion K2 transmits the rotation drive force of the motor M1 rotating in the second rotation direction to the upper container cover 70, to cause the upper container cover 70 to switch from the closed state to the open state, and regulates transmission of the rotation drive force of the motor M1 rotating in the first rotation direction to the upper container cover 70.

The above-described motor M1 has a motor shaft MG. The first drive transmission portion K1 has an input gear 81 which engages with the motor shaft MG, and a one-way gear 82 which engages with the input gear 81. The one-way gear 82 engages with the first container gear 51G of the upper toner container 51. The one-way gear 82 transmits the rotation drive force of the motor M1 in the first rotation direction to the first container gear 51G. On the other hand, when the motor M1 is rotated in the second rotation direction, idling of the one-way gear 82 prevents transmission of the rotation drive force of the motor M1 to the first container gear 51G.

Figure 9:
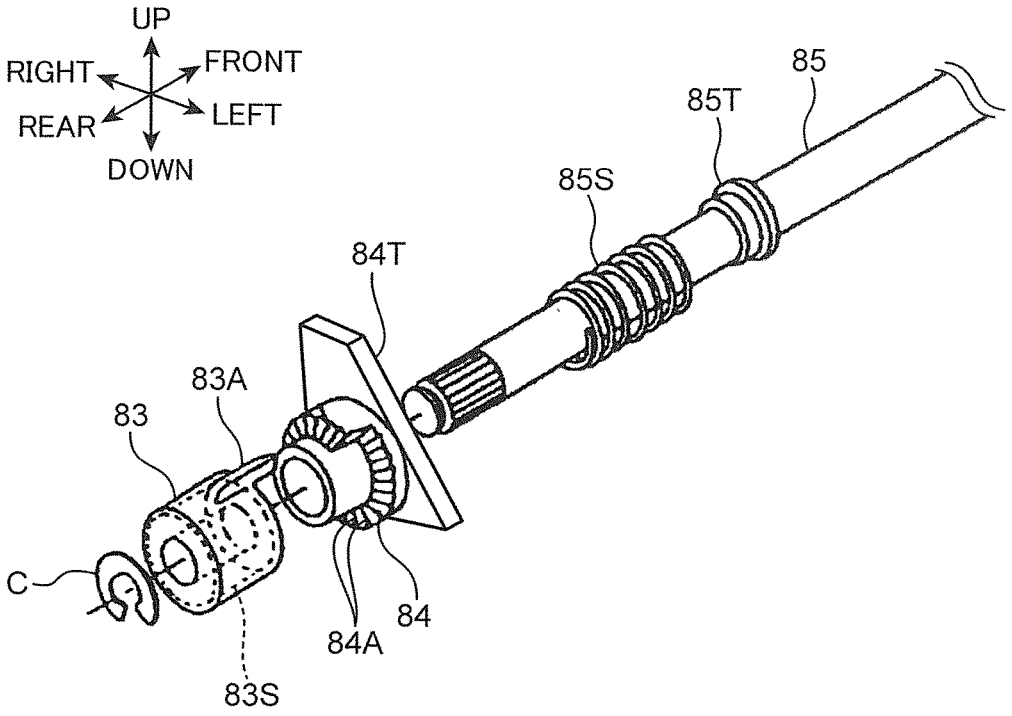
FIG. 9 is a perspective view showing a part of the drive portion according to the first embodiment of the present disclosure.
Figure 10A:
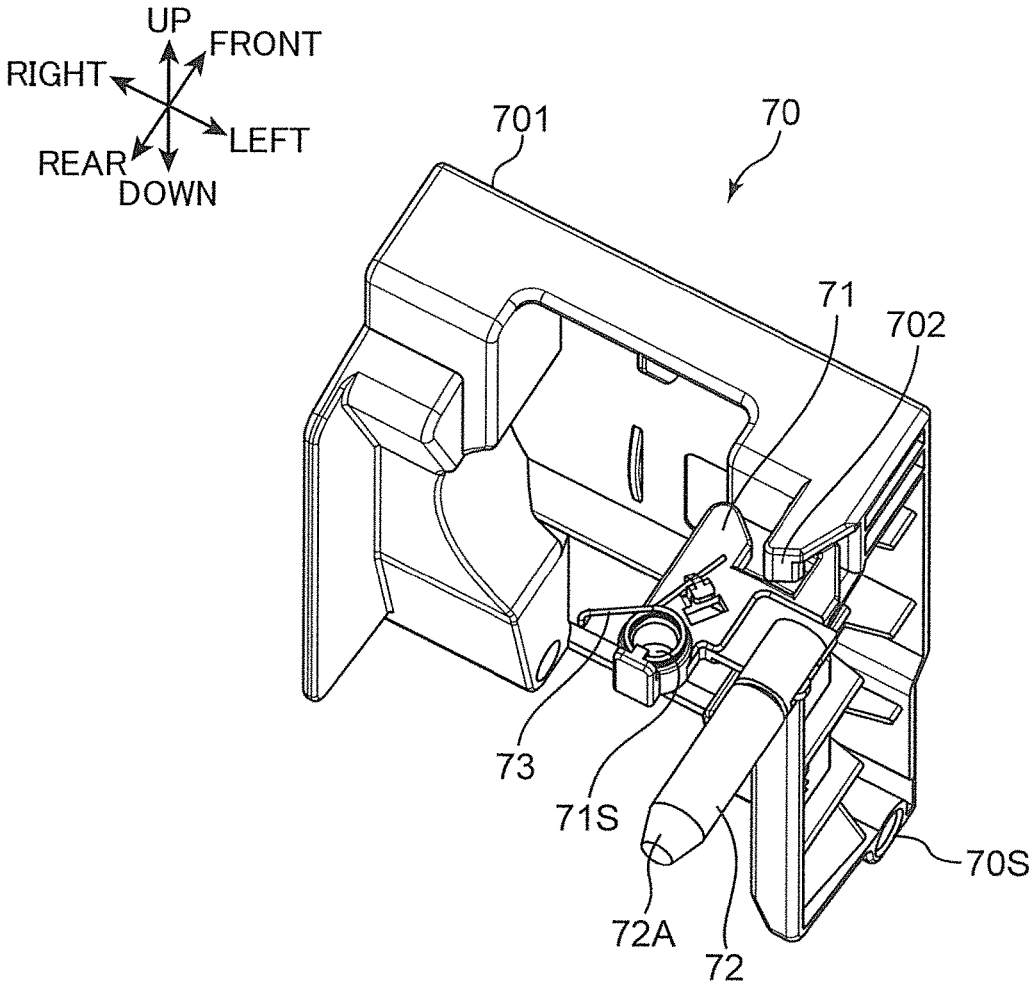
FIG. 10A is a perspective view showing a state where the container cover according to the first embodiment of the present disclosure is locked.
Figure 10B:
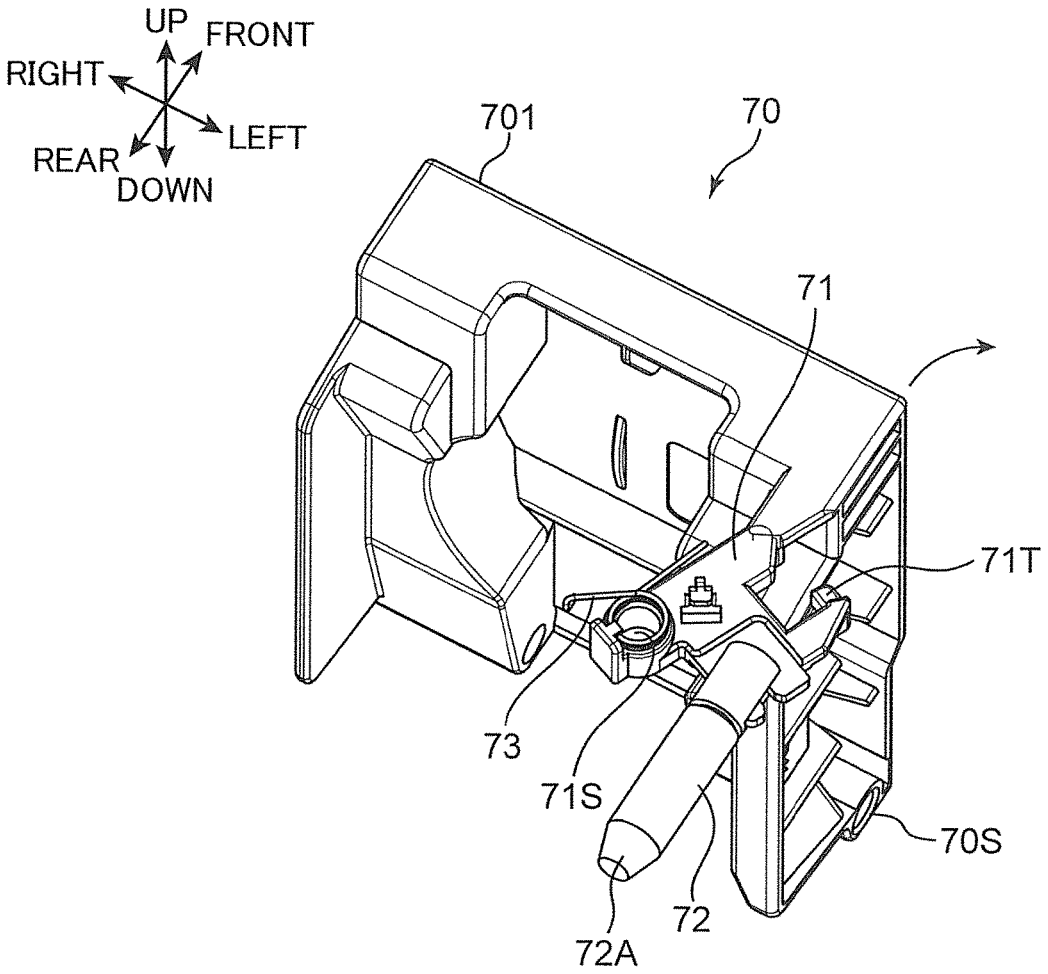
FIG. 10B is a perspective view showing a state where the container cover according to the first embodiment of the present disclosure is unlocked.
Figure 11A:
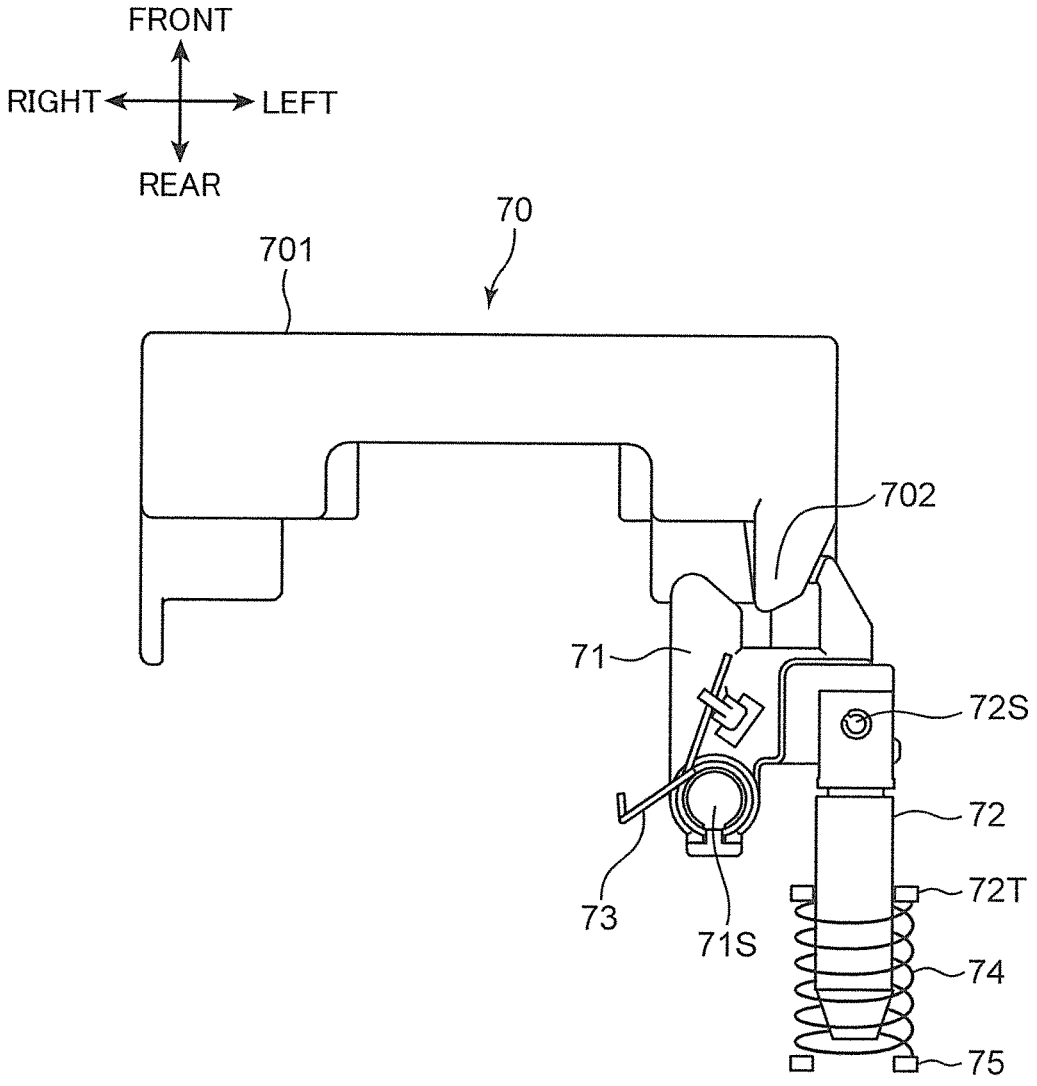
FIG. 11A is a plan view showing a state where the container cover according to the first embodiment of the present disclosure is locked.
Figure 11B:
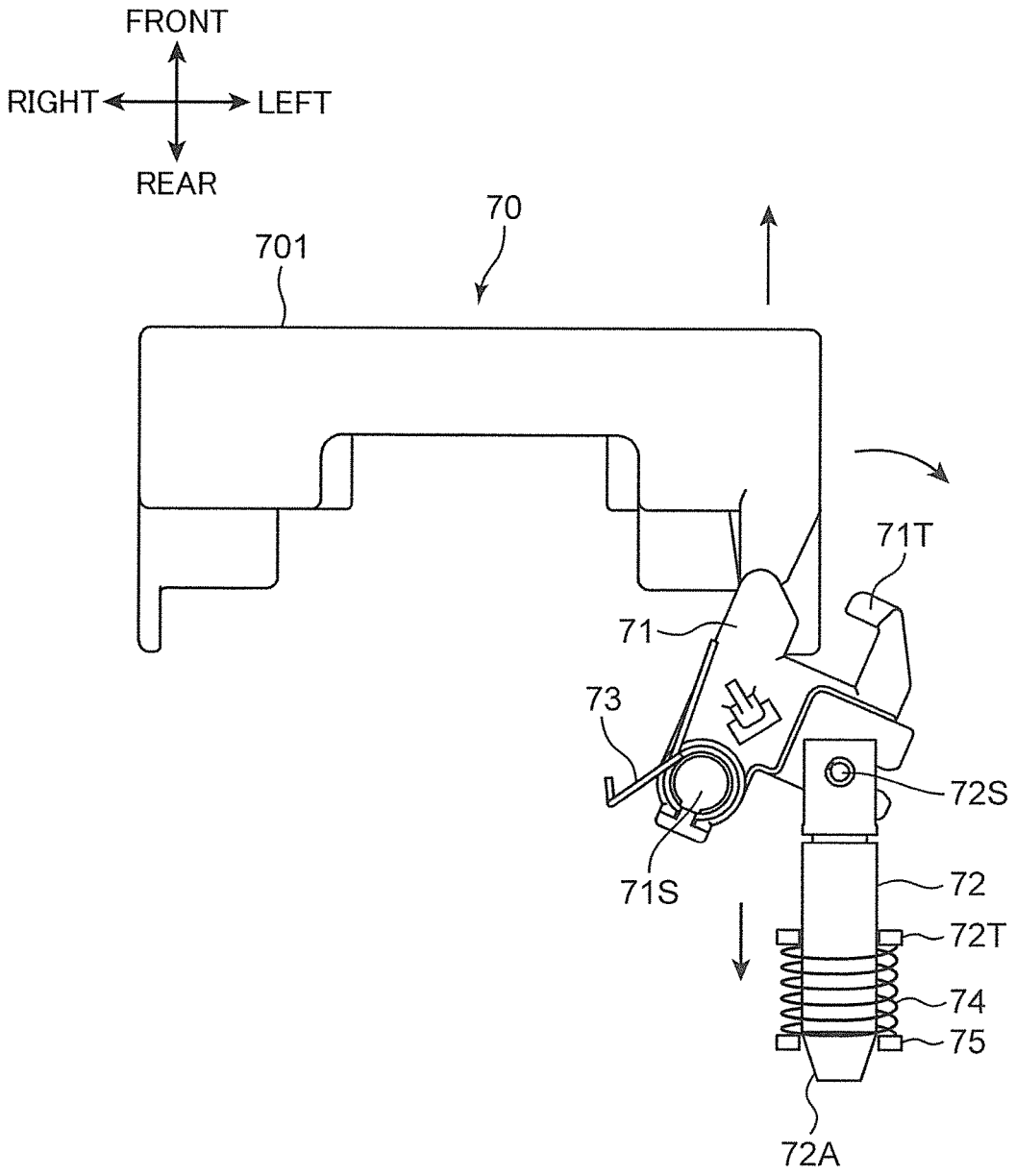
FIG. 11B is a plan view showing a state where the container cover according to the first embodiment of the present disclosure is unlocked.

FIG. 9 is a perspective view showing a part of the drive portion J according to the present embodiment. FIG. 10A is a perspective view showing a state where the upper container cover 70 according to the present embodiment is locked, and FIG. 10B is a perspective view showing a state where the upper container cover 70 is unlocked. FIG. 11A is a plan view showing a state where the upper container cover 70 is locked, and FIG. 11B is a plan view showing a state where the upper container cover 70 is unlocked.

The second drive transmission portion K2 has a lock portion 71 (FIG. 10A) and a lock transmission portion L (FIG. 6, FIG. 7). On the other hand, the upper container cover 70 has a container cover main body 701, an engaged portion 702, and the above-described cover supporting portion 70S. The container cover main body 701 is a main body portion of the upper container cover 70 and has a generally rectangular solid-shape. The engaged portion 702 is arranged, on the upper end side of the container cover main body 701, in a rear left end portion thereof. The engaged portion 702 is engageable with a lock piece 71T of the lock portion 71.

The lock portion 71 is supported in the device main body 11 so as to reciprocate and has a function of locking the upper container cover 70 in the closed state. The lock portion 71 has a lock supporting portion 71S and the lock piece 71T. The lock supporting portion 71S functions as a supporting point for reciprocation of the lock portion 71. The lock piece 71T is arranged at a front end part of turning of the lock portion 71 around the lock supporting portion 71S, and is engaged with the above-described engaged portion 702 of the upper container cover 70 to lock the upper container cover 70 in the closed state. As shown in FIG. 10A and FIG. 10B, a coil spring 73 is fixed to the lock supporting portion 71S of the lock portion 71. The coil spring 73 urges the lock portion 71 around the lock supporting portion 71S such that the lock portion 71 is arranged at a locked position shown in FIG. 10A. As shown in FIG. 6 and FIG. 7, the upper container cover 70 and the lock portion 71 are arranged to be opposed to the other end side (the front end portion) of the upper toner container 51 in the axial direction.

The lock transmission portion L transmits the rotation drive force of the motor M1 rotating in the second rotation direction to the lock portion 71 to cause the lock portion 71 to reciprocate, thus unlocking the upper container cover 70 and causing the upper container cover 70 to switch from the closed state to the open state. The lock transmission portion L has the input gear 81 which is commonly used for the first drive transmission portion K1, a cam gear 83, a fixed cam 84, a shaft 85, and a slide pin 72 (FIG. 10A).

As described above, the input gear 81 is coupled to the motor shaft MG of the motor M1. The cam gear 83 is coupled to the input gear 81. A one-way clutch (not shown) is attached in the cam gear 83. The fixed cam 84 is arranged ahead of the cam gear 83. The shaft 85 extends forward from the cam gear 83 along the axial direction, and is coupled to the lock portion 71 via the slide pin 72. The cam gear 83 and the fixed cam 84 configure a conversion transmission portion of the present disclosure. The conversion transmission portion converts a rotation drive force of the motor M1 in the second rotation direction to be transmitted to the input gear 81 to slide movement in the axial direction of the shaft 85 to cause the lock portion 71 to reciprocate, thus allowing the upper container cover 70 to be opened.

With reference to FIG. 9, the cam gear 83 has an engagement protrusion 83A and a cylindrical inner space 83S. The engagement protrusion 83A is a protrusion portion protruding forward from a part of the cam gear 83 in a circumferential direction. The cylindrical inner space 83S is a cylindrical space formed inside the cam gear 83. The cylindrical inner space 83S internally includes a tubular portion of the fixed cam 84. On the other hand, the fixed cam 84 is fixed to a cam seat plate 84T provided in the device main body 11. The fixed cam 84 has a cam face 84A. The cam face 84A is continuously formed along the circumferential direction so as to have a height with respect to the cam seat plate 84T varying. A part (top portion) of the cam face 84A is arranged at a rearmost position with respect to the cam seat plate 84T and other part (trough portion) of the cam face 84A is arranged at a position closest to the cam seat plate 84T. A front end portion (rear end portion) of the shaft 85 passes through in the tubular portion of the fixed cam 84, as well as passing through the cylindrical inner space 83S of the cam gear 83. Then, attachment of a C clip to the front end portion of the shaft 85 protruding backward from a hole portion opened in a rear face portion of the cam gear 83 integrates the cam gear 83, the fixed cam 84, and the shaft 85. As shown in FIG. 9, a coil spring 85S is arranged being compressed between a ring-shaped flange 85T provided to protrude from a circumference surface of the shaft 85 and the cam seat plate 84T.

The slide pin 72 has a function of coupling the lock portion 71 and the shaft 85. As shown in FIG. 10A to FIG. 11B, the slide pin 72 has a pin-shape extending in the front-rear direction. The slide pin 72 has a pin front end portion 72A, a pin supporting portion 72S, and a pin seat plate 72T. The pin front end portion 72A is fixed to the front end portion of the shaft 85 described above. The slide pin 72 is also coupled to the lock portion 71 so as to be capable of reciprocating with the pin supporting portion 72S as a supporting point. The pin seat plate 72T is a ring-shaped flange provided at a generally central part of the slide pin 72 in the front-rear direction so as to extend from an outer circumferential portion of the slide pin 72. On the other hand, the device main body 11 has a main body seat plate 75 at a position backward of and spaced apart from the pin seat plate 72T. A coil spring 74 is arranged being compressed between the pin seat plate 72T and the main body seat plate 75.

Further, the image forming device 10 has a toner sensor 100 and a container controller 101 (FIG. 6). The toner sensor 100 detects that an amount of a toner in the upper toner container 51 has fallen below a predetermined threshold. In other words, the toner sensor 100 detects that the toner in the upper toner container 51 has become empty. The toner sensor 100, which is formed with a magnetic permeability sensor, detects a toner filling the upper toner container 51. In a case where the upper toner container 51 is internally filled with a sufficient toner, the toner sensor 100 outputs a HIGH signal (+5 V). On the other hand, in a case where a toner hardly exists in the upper toner container 51, the toner sensor 100 outputs a LOW signal (0 V). In other embodiment, the toner sensor 100 may be a PI sensor (photo sensor). In this case, an outer wall of the upper toner container 51 is made of a transparent pipe member, and the PI sensor detects presence/absence of a toner in the upper toner container 51. Also in other embodiment, the toner sensor 100 may be arranged in a part of the toner transport unit 53.

The container controller 101 controls rotation of the motor M1. In particular, when the toner sensor 100 continuously detects that the amount of toner in the upper toner container 51 has fallen below the threshold value (the LOW signal), the container controller 101 causes the motor M1 to rotate in the second rotation direction to open the upper container cover 70. Specifically, when the toner sensor 100 corresponding to the upper toner container 51 for yellow color detects that the toner in the upper toner container 51 has become empty, the container controller 101 causes a display (not shown) of the image forming device 10 to display toner empty information. As a result, a user of the image forming device 10 replaces the upper toner container 51 for yellow color. First, when the user opens the front cover 11A of the device main body 11 (FIG. 5), the open state of the front cover 11A is detected by the cover detection portion 11B. Upon receiving detection information that the front cover 11A is opened, the container controller 101 executes opening operation of the upper container cover 70 for yellow color. In other words, the motor M1 is rotated in the second rotation direction. As a result, the cam gear 83 is rotated via the motor shaft MG and the input gear 81, so that the engagement protrusion 83A moves along the cam face 84A of the fixed cam 84 in a circumferential direction thereof. By rotating the motor M1 by a rotation angle set in advance, the container controller 101 stops rotation of the cam gear 83 in a state where the engagement protrusion 83A contacts a part of the cam face 84A, the part being at a frontmost position. As a result, the shaft 85 coupled to the cam gear 83 is slid to move to the rearmost position. Accordingly, the lock portion 71 and the slide pin 72 shift from the state shown in FIG. 10A and FIG. 11A to the state shown in FIG. 10B and FIG. 11B (see arrows in FIG. 11B). As a result, the lock piece 71T of the lock portion 71 is released from the engaged portion 702 of the upper container cover 70 to open the upper container cover 70 (FIG. 5).

When the user finishes replacing the upper toner container 51, the upper container cover 70 is closed by the user. Prior to the operation, the container controller 101 causes the motor M1 to further rotate in the second rotation direction to stop rotation of the cam gear 83 in a state where the engagement protrusion 83A of the cam gear 83 contacts a part of the cam face 84A of the fixed cam 84, the part being at a rearmost position. As a result, the shaft 85 coupled to the cam gear 83 is slid to move to the frontmost position. Accordingly, the lock portion 71 and the slide pin 72 shift from the state shown in FIG. 10B and FIG. 11B to a state shown in FIG. 10A and FIG. 11A. As a result, according to closing operation of the upper container cover 70, the lock piece 71T of the lock portion 71 is again allowed to engage with the engaged portion 702 of the upper container cover 70. Accordingly, the upper container cover 70 is again maintained in the closed state. Upon the shift from the state shown in FIG. 10B and FIG. 11B to the state shown in FIG. 10A and FIG. 11A, an urging force of the coil spring 74 assists reciprocation of the lock portion 71.

On the other hand, in ordinary image forming operation of the image forming device 10, the container controller 101 controls toner replenishing operation of the upper toner container 51. Specifically, when a toner sensor (not shown) which is provided in the developing device 23 detects a decrease of an amount of a toner in the developing device 23, the operation of replenishing a toner from the upper toner container 51 to the developing device 23 is executed. At this time, the container controller 101 causes the motor M1 to rotate in the first rotation direction, so that the first container gear 51G is rotated via the motor shaft MG and the input gear 81. As a result, the upper toner container 51 is rotated to transport the toner in the upper toner container 51 toward the fixed portion 51A (the upper shutter 51S). In FIG. 8, rotation directions of the upper toner container 51 and the like at the time of rotation of the motor M1 in the first rotation direction are indicated by arrows. The toner reaching the fixed portion 51A is replenished to the developing device 23 via the toner transport unit 53. At this time, a controller (not shown) causes each transport screw of the toner transport unit 53 to rotate. Determination of execution of the toner replenishing operation may be made based on a detection result of a toner sensor (not shown) provided in the toner transport unit 53, or may be made according to a detection result of a concentration of a toner patch formed on the intermediate transfer belt 141 of the intermediate transfer unit 14.

As described above, the drive transmission unit K transports a toner in the upper toner container 51 by the rotation drive force of the motor M1 in the first rotation direction in the present embodiment. The drive transmission unit K also opens the upper container cover 70 by the rotation drive force of the motor M1 in the second rotation direction. Therefore, it is unnecessary to have dedicated driving sources (motors) for transport of the toner in the upper toner container 51 and opening of the upper container cover 70. As a result, it is possible to realize opening/closing operation of the upper container cover 70 which externally opens the upper toner container 51 at low costs. This is also the case with opening/closing operation of the lower container cover 90 which externally opens the lower toner container 52.

Also in the present embodiment, reciprocating the lock portion 71 by the lock transmission portion L based on the rotation drive force of the motor M1 in the second rotation direction enables the upper container cover 70 to be unlocked to allow the upper container cover 70 to switch from the closed state to the open state. Further, by transmitting the rotation drive force of the motor M1 arranged on the one end side of the upper toner container 51 in the axial direction as slide movement of the shaft 85 to the other end side of the upper toner container 51 in the axial direction, the lock portion 71 can be reciprocated to open the upper container cover 70.

Also in the present embodiment, provision of the toner sensor 100 and the container controller 101 enables the upper container cover 70 to be opened when an amount of the toner in the upper toner container 51 is reduced to require replacement of the upper toner container 51. At this time, the upper container cover 70 can be opened on the assumption that the front cover 11A is opened by the provision of the cover detection portion 11B. Therefore, it is possible to prevent failure of the drive transmission unit K which opens the upper container cover 70.

Additionally, in the present embodiment, two toner containers are arranged for the developing device 23 in the device main body 11. Then, the upper toner container 51 and the lower toner container 52 are arranged in the device main body 11 so as to be adjacent to each other horizontally and in the up-down direction (obliquely). Therefore, as compared with a case where two toner containers are arranged to be adjacent to each other only horizontally, an increase in a horizontal width of the device main body 11 can be prevented. The container controller 101 controls the drive portions J provided for the upper toner container 51 and the lower toner container 52 so as to supply a toner from one toner container of the upper toner container 51 or the lower toner container 52 to the developing device 23, and when the one toner container becomes empty, to supply a toner of the other toner container of the upper toner container 51 or the lower toner container 52 to the developing device 23. Therefore, even when the upper toner container 51 becomes empty, the lower toner container 52 enables image forming operation to be executed quickly. As a result, it is possible to reduce frequency and time of stop of the image forming operation caused by replacement of the toner container.

Also in the present embodiment, the upper toner container 51 and the lower toner container 52 are arranged at the same position in the attachment direction in the device main body 11. Therefore, as compared with a case where the upper toner container 51 and the lower toner container 52 are arranged displaced from each other in the front-rear direction, the size of the device main body 11 in the front-rear direction can be reduced. Then, using the container stepped portion H formed by the two toner containers, a part of the toner transport unit 53 can be efficiently arranged.

Figure 13:
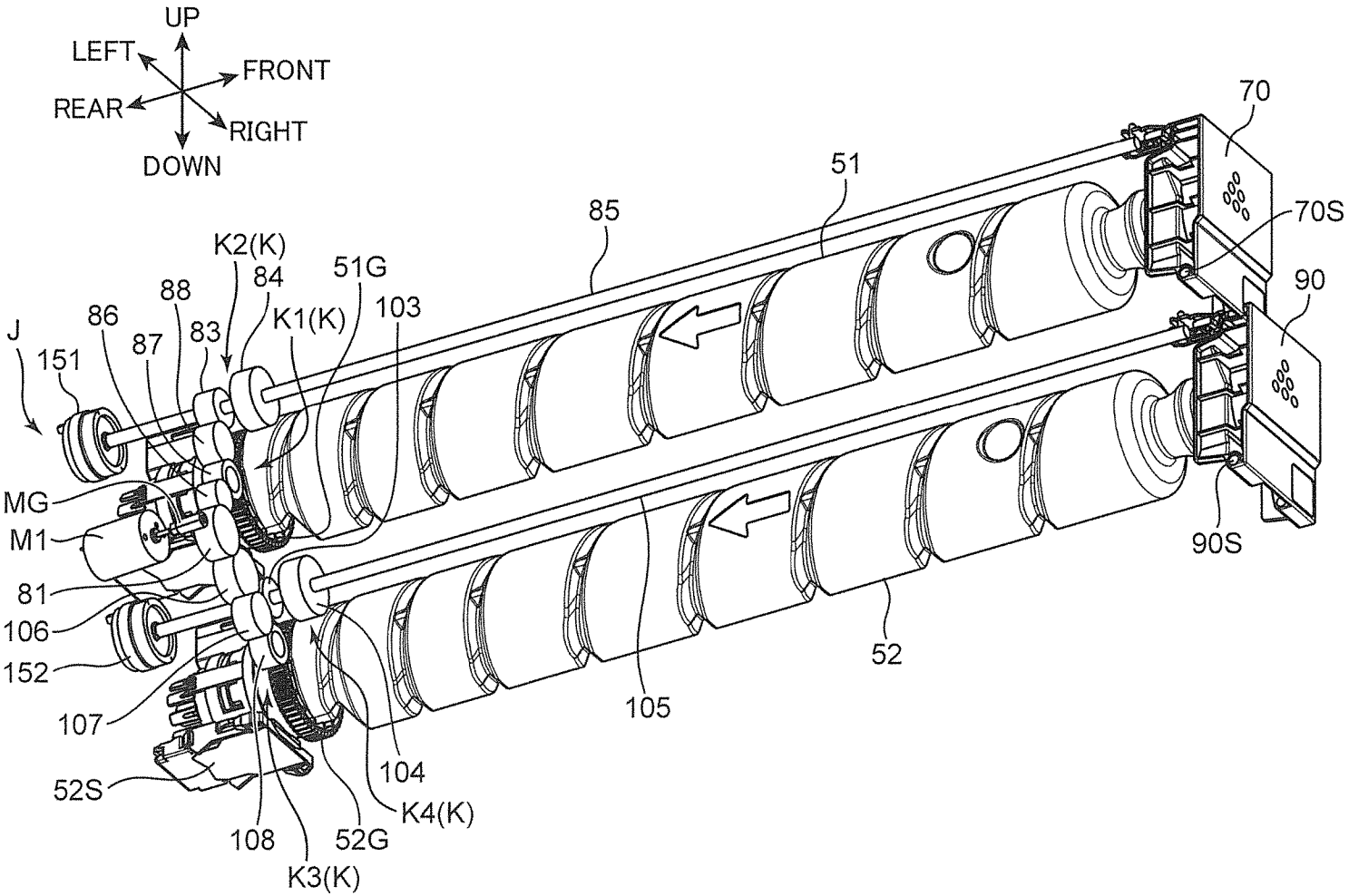
FIG. 13 is a perspective view of the toner container, the drive portion, and the container cover according to the second embodiment of the present disclosure.
Figure 14:
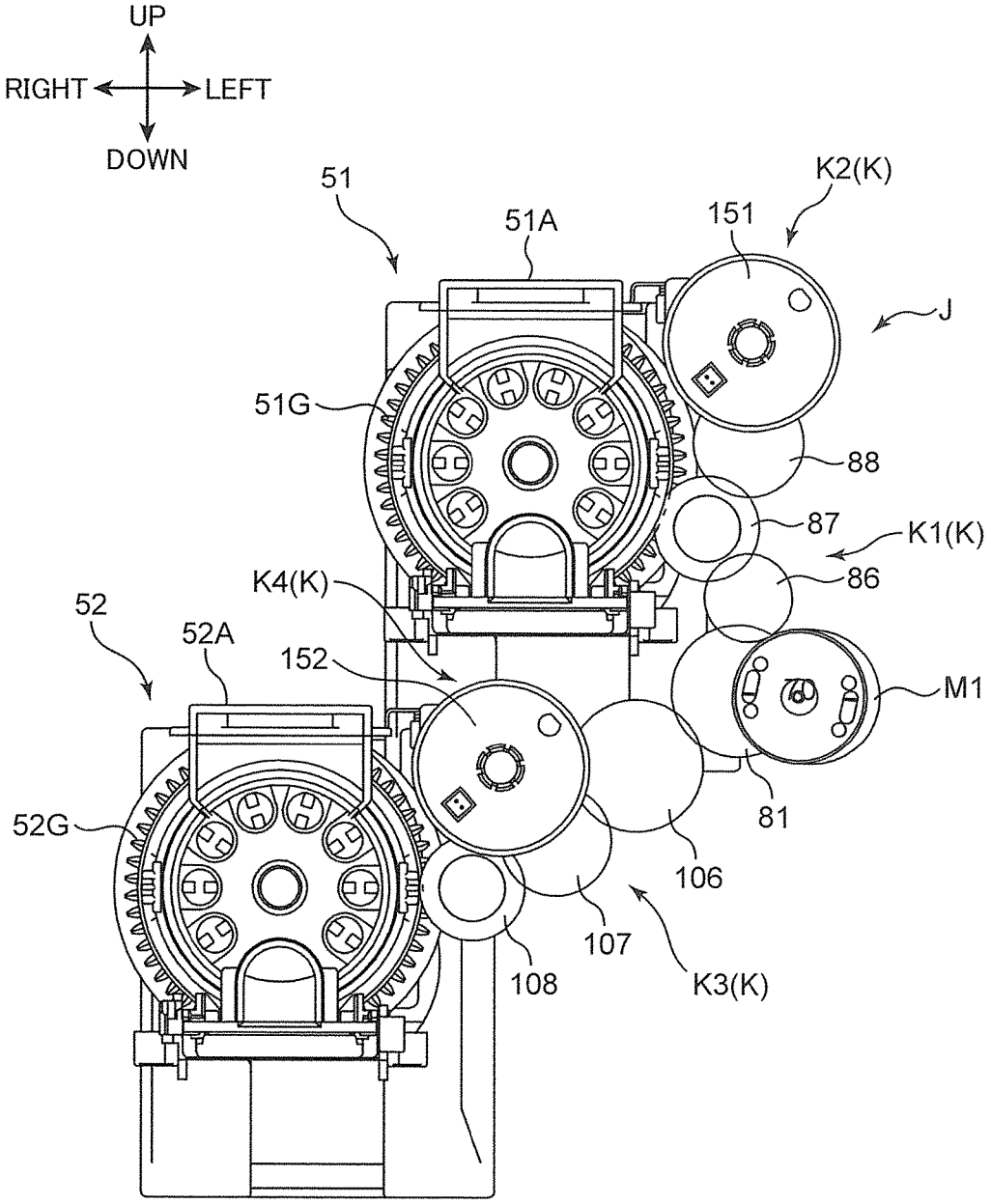
FIG. 14 is a rear view of the toner container, the drive portion, and the container cover according to the second embodiment of the present disclosure.
Figure 15A:
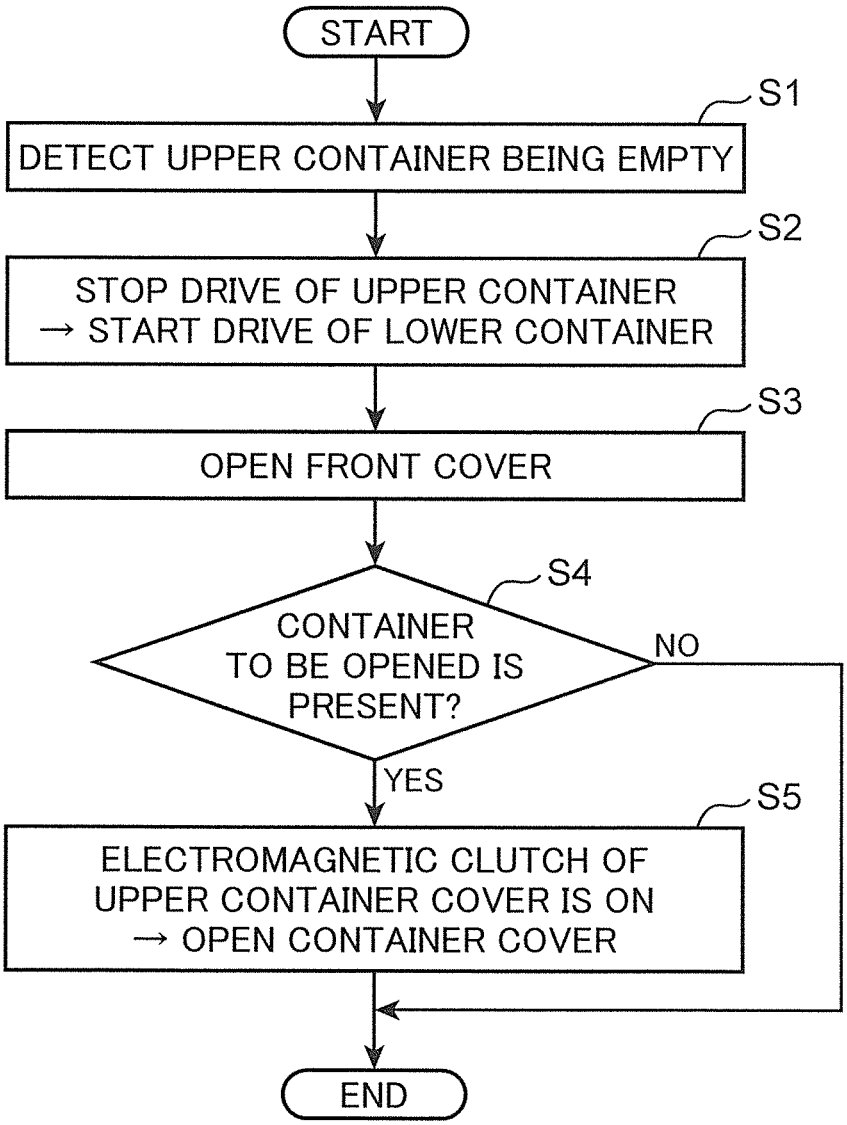
FIG. 15A is a flow chart showing steps until the container cover according to the second embodiment of the present disclosure is opened.
Figure 15B:
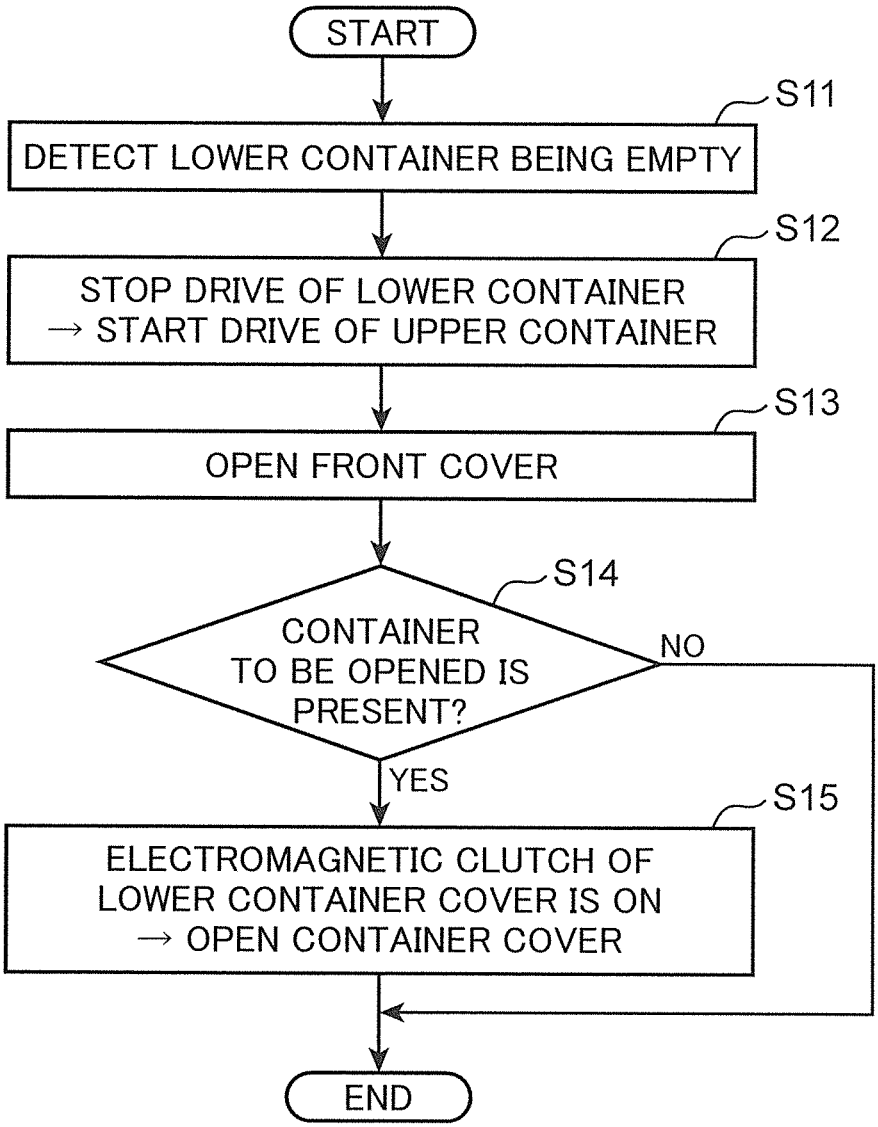
FIG. 15B is another flow chart showing steps until the container cover according to the second embodiment of the present disclosure is opened.

Next, with reference to FIG. 12 to FIG. 15B, a second embodiment of the present disclosure will be described. FIG. 12 to FIG. 14 are a side view, a perspective view, and a rear view of the upper toner container 51, the lower toner container 52, the drive portion J, the upper container cover 70, and the lower container cover 90 according to the present embodiment. FIG. 15A and FIG. 15B are flow charts showing steps until the upper container cover 70 and the lower container cover 90 according to the present embodiment are opened. Since the present embodiment differs in a drive transmission structure of the drive portion J in the image forming device 10 including the configuration of the image forming portion 13 similar to the first embodiment, description will be made mainly of the difference and description of the remaining common part will be omitted. In FIG. 12 to FIG. 14, members having the same functions as those of the first embodiment are given the same reference codes as those of FIG. 1 to FIG. 11.

In the present embodiment, the plurality of toner containers provided in the image forming device 10 each have, for each color, the upper toner container 51 (the first toner container) which houses a toner to be replenished to the developing device 23, and the lower toner container 52 (the second toner container) which is arranged adjacent to the upper toner container 51 and houses a toner to be replenished to the same developing device 23 as that of the upper toner container 51. The plurality of container covers have the upper container cover 70 capable of switching between an open state of allowing attachment/detachment of the upper toner container 51 to/from the device main body 11 and a closed state of preventing removal of the upper toner container 51 from the device main body 11, and the lower container cover 90 capable of switching between an open state of allowing attachment/detachment of the lower toner container 52 to/from the device main body 11 and a closed state of preventing removal of the lower toner container 52 from the device main body 11.

The drive transmission unit K has the first drive transmission portion K1, the second drive transmission portion K2, a third drive transmission portion K3, and a fourth drive transmission portion K4. By transmitting the rotation drive force of the motor M1 rotating in the first rotation direction to the upper toner container 51, the first drive transmission portion K1 transports a toner housed in the upper toner container 51 in a predetermined direction and regulates transmission of the rotation drive force of the motor M1 rotating in the second rotation direction to the upper toner container 51. By transmitting the rotation drive force of the motor M1 rotating in the second rotation direction to the upper container cover 70, the second drive transmission portion K2 causes the upper container cover 70 to switch from the closed state to the open state, and regulates transmission of the rotation drive force of the motor M1 rotating in the first rotation direction to the upper container cover 70. By transmitting the rotation drive force of the motor M1 rotating in the second rotation direction to the lower toner container 52, the third drive transmission portion K3 transports a toner housed in the lower toner container 52 in a predetermined direction, and regulates transmission of the rotation drive force of the motor M1 rotating in the first rotation direction to the lower toner container 52. Further, by transmitting the rotation drive force of the motor M1 rotating in the first rotation direction to the lower container cover 90, the fourth drive transmission portion K4 causes the lower container cover 90 to switch from the closed state to the open state, and regulates transmission of the rotation drive force of the motor M1 rotating in the second rotation direction to the lower container cover 90.

Although not shown, also in the present embodiment, the toner sensors 100 (FIG. 6) are arranged to be opposed to the upper toner container 51 and the lower toner container 52, respectively, and the container controllers 101 (FIG. 6) are provided which control the motor M1, the first drive transmission portion K1, the second drive transmission portion K2, the third drive transmission portion K3, and the fourth drive transmission portion K4 according to detection results of these toner sensors 100. The container controller 101 selectively causes the motor M1 to rotate in the first rotation direction or the second rotation direction to replenish a toner to the predetermined developing device 23 from the upper toner container 51 or the lower toner container 52.

With reference to FIG. 12 to FIG. 14, the first drive transmission portion K1 has the input gear 81, a gear 86, and a one-way gear 87 (a first clutch). The input gear 81 engages with the motor shaft MG of the motor M1 and the gear 86 engages with the input gear 81. The one-way gear 87 engages with the first container gear 51G of the upper toner container 51. The one-way gear 87 transmits only the rotation drive force of the motor M1 rotating in the first rotation direction to the first container gear 51G. In other words, with respect to the one-way gear 87, the one-way gear 87 allows transmission of the rotation drive force of the motor M1 rotating in the first rotation direction to the upper toner container 51, and regulates transmission of the rotation drive force of the motor M1 rotating in the second rotation direction to the upper toner container 51.

The second drive transmission portion K2 has a gear 88, the cam gear 83, the fixed cam 84, the shaft 85, and a first electromagnetic clutch 151 (a third clutch) in addition to the input gear 81, the gear 86, and the one-way gear 87 which are commonly used by the first drive transmission portion K1. The gear 88 engages with the one-way gear 87 at a different position in the circumferential direction from the first container gear 51G. The cam gear 83 engages with the gear 88. Structures of the cam gear 83, the fixed cam 84, and the shaft 85 are the same as those of the first embodiment. The front end portion of the shaft 85 is coupled to the upper container cover 70 through the slide pin 72 and the lock portion 71 in the same manner as in the first embodiment. The first electromagnetic clutch 151 is controlled by the container controller 101 to switch on/off of transmission of a rotation drive force from the gear 88 to the cam gear 83. In particular, the first electromagnetic clutch 151 regulates transmission of the rotation drive force of the motor M1 rotating in the first rotation direction to the upper container cover 70.

The third drive transmission portion K3 includes a gear 106, a gear 107, and a one-way gear 108 (a second clutch) in addition to the input gear 81 commonly used by the first drive transmission portion K1. The gear 106 engages with the input gear 81 and the gear 107 engages with the gear 106. The one-way gear 108 engages with the gear 107 and transmits only the rotation drive force of the motor M1 rotating in the second rotation direction to the second container gear 52G. In other words, with respect to the one-way gear 108, the one-way gear 108 allows transmission of the rotation drive force of the motor M1 rotating in the second rotation direction to the lower toner container 52, and regulates transmission of the rotation drive force of the motor M1 rotating in the first rotation direction to the lower toner container 52.

The fourth drive transmission portion K4 has a cam gear 103, a fixed cam 104, a shaft 105, and a second electromagnetic clutch 152 (a fourth clutch) in addition to the input gear 81, the gear 106, and the gear 107 which are commonly used by the third drive transmission portion K3. The cam gear 103 engages with the gear 106 at a different position in the circumferential direction from the gear 107. Structures of the cam gear 103, the fixed cam 104, and the shaft 105 are the same as those of the cam gear 83, the fixed cam 84, and the shaft 85. A front end portion of the shaft 105 is coupled to the lower container cover 90 through the slide pin 72 and the lock portion 71 in the same manner as in the first embodiment. The second electromagnetic clutch 152 is controlled by the container controller 101 to switch on/off of transmission of a rotation drive force from the gear 107 to the cam gear 103. In particular, the second electromagnetic clutch 152 regulates transmission of the rotation drive force of the motor M1 rotating in the second rotation direction to the lower container cover 90.

Also in the present embodiment, when it is detected by the toner sensor 100 (a first toner detection portion) that an amount of a toner in the upper toner container 51 has fallen below the threshold value, the container controller 101 causes the motor M1 to rotate in the second rotation direction to open the upper container cover 70. When it is detected by the toner sensor 100 (a second toner detection portion) that an amount of a toner in the lower toner container 52 has fallen below the threshold value, the container controller 101 also causes the motor M1 to rotate in the first rotation direction to open the lower container cover 90. At this time, when the cover detection portion 11B detects that the front cover 11A is opened, the container controller 101 opens the upper container cover 70 or the lower container cover 90. In the following, the above-described opening operation of the upper container cover 70 or the lower container cover 90 will be further described with reference to FIG. 15A and FIG. 15B.

With reference to FIG. 15A, when the toner sensor 100 opposed to the upper toner container 51 detects that a toner in the upper toner container 51 has become empty (empty) (Step S1), the container controller 101 stops rotation drive of the upper toner container 51, i.e. rotation of the motor M1 in the first rotation direction. Then, the container controller 101 starts rotation drive of the lower toner container 52, i.e., rotation of the motor M1 in the second rotation direction (Step S2). Thereafter, when user's opening of the front cover 11A (the front cover) is detected by the cover detection portion 11B (Step S3), the container controller 101 detects presence/absence of a toner container to be opened (Step S4). At this time, since a toner in the upper toner container 51 is ordinarily empty as described above (YES in Step S4), the container controller 101 turns on the first electromagnetic clutch 151 to transmit a rotation drive force from the gear 88 to the cam gear 83 (Step S5). At this time, since the motor M1 is rotated in the second rotation direction, the rotation drive force is transmitted to the cam gear 83. The first container gear 51G is never rotated by a function of the one-way gear 87. As a result, the shaft 85 is slid to move in the axial direction to open the upper container cover 70 by the same procedure as in the first embodiment. In Step S4, in a case where a toner container whose toner empty information is detected is not present (NO in Step S4), the container controller 101 ends the control flow. By the control, it is possible to cope with such a case where the upper container cover 70 is suddenly opened by a user. The motor M1 rotates in the second rotation direction for replenishing a toner from the lower toner container 52 to the developing device 23. At this time, in order to prevent erroneous opening of the upper container cover 70, the container controller 101 interrupts transmission of a rotation drive force from the gear 88 to the cam gear 83 by turning off the first electromagnetic clutch 151.

Similarly, with reference to FIG. 15B, when the toner sensor 100 opposed to the lower toner container 52 detects that a toner in the lower toner container 52 has become empty (empty) (Step S11), the container controller 101 stops rotation drive of the lower toner container 52, i.e., rotation of the motor M1 in the second rotation direction. Then, the container controller 101 starts rotation drive of the upper toner container 51, i.e., rotation of the motor M1 in the first rotation direction (Step S12). Thereafter, when user's opening of the front cover 11A (the front cover) is detected by the cover detection portion 11B (Step S13), the container controller 101 detects presence/absence of a toner container to be opened (Step S14). At this time, since the toner in the lower toner container 52 is empty as described above (YES in Step S14), the container controller 101 turns on the second electromagnetic clutch 152 to transmit a rotation drive force from the gear 107 to the cam gear 103 (Step S15). At this time, since the motor M1 is rotated in the first rotation direction, the rotation drive force is transmitted to the cam gear 103. The second container gear 52G is never rotated by a function of the one-way gear 108. As a result, the shaft 105 is slid to move in the axial direction to open the lower container cover 90 by the same procedure as in the first embodiment. In Step S14, in a case where a toner container whose toner empty information is detected is not present (NO in Step S14), the container controller 101 ends the control flow. The motor M1 rotates in the first rotation direction for replenishing a toner from the upper toner container 51 to the developing device 23. At this time, in order to prevent erroneous opening of the lower container cover 90, the container controller 101 interrupts transmission of a rotation drive force from the gear 107 to the cam gear 103 by turning off the second electromagnetic clutch 152.

In the present embodiment, the number of gears of the first drive transmission portion K1 and the third drive transmission portion K3 are appropriately set such that a rotation direction of the upper toner container 51 according to rotation of the motor M1 in the first rotation direction and a rotation direction of the lower toner container 52 according to rotation of the motor M1 in the second rotation direction are the same.

As described above, in the present embodiment, rotation drive forces of the motor M1 in the first rotation direction and in the second rotation direction realize transportation of toners in the upper toner container 51 and the lower toner container 52 and opening operation of the upper container cover 70 and the lower container cover 90. As a result, opening/closing operation of the plurality of container covers which externally open the plurality of toner containers can be realized at low costs.

Also in the present embodiment, by selectively rotating the motor M1 in the first rotation direction or in the second rotation direction, the container controller 101 replenishes a toner from the upper toner container 51 or the lower toner container 52 to the developing device 23. Therefore, for example, even in a case where the upper toner container 51 has become empty, image forming operation can be quickly executed by the lower toner container 52. As a result, it is possible to reduce frequency and time of stop of the image forming operation caused by replacement of the toner container.

Also in the present embodiment, erroneous toner transportation can be prevented by the one-way gear 87 and the one-way gear 108 in the upper toner container 51 and the lower toner container 52. Further, the first electromagnetic clutch 151 and the second electromagnetic clutch 152 prevent the upper container cover 70 and the lower container cover 90 from being erroneously opened.

Further, also in the present embodiment, the upper toner container 51 and the lower toner container 52 are each provided with the toner sensor 100, and the container controller 101 controls a rotation direction of the motor M1 according to a detection result of the toner sensor 100. Accordingly, when an amount of a toner in the upper toner container 51 or the lower toner container 52 is reduced and replacement of the toner container is required, the upper container cover 70 or the lower container cover 90 can be opened. At this time, assuming that the front cover 11A is opened, the upper container cover 70 or the lower container cover 90 can be opened. It is therefore possible to prevent a failure of the drive transmission unit K which causes each container cover to open.

The image forming devices 10 according to the respective embodiments of the present disclosure have been described above in detail. Such a configuration provides an image forming device which realizes opening/closing operation of a container cover which externally opens a toner container at low costs. The present disclosure is not limited thereto. The present disclosure can assume such a modified embodiment as set forth below.

(1) While in the above-described embodiments, the description has been made of a mode in which the toner replenishing units 5 and the developing devices 23 are arranged according to toners of four colors, the present disclosure may be applicable to an image forming device for single color (monochrome etc.). In other words, the numbers of the developing devices 23, the upper toner containers 51, the lower toner containers 52, the drive portions J, and the drive transmission units K are not limited to those of the above-described embodiments. The image forming device 10 includes at least one photosensitive drum 20, at least one developing device 23, and at least one drive portion J. Additionally, the device main body 11 includes at least one container cover (70, 90). The number of gears that each of the first drive transmission portions K1, the second drive transmission portions K2, the third drive transmission portions K3, and the fourth drive transmission portions K4 has is not limited to that of the above-described embodiments.

(2) While in the above-described embodiment, the description has been made of a mode in which the upper toner container 51 and the lower toner container 52 transport toners therein as a result of rotation of the main body portion of the container, the toner container may include therein a rotatable toner transportation member such as a screw. In this case, when a rotation drive force is transmitted to the first container gear 51G or the second container gear 52G, the above-described toner transportation member is rotated to transport a toner.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. An image forming device comprising:

a device main body;

an image forming portion which forms a toner image; and a transfer portion which transfers the toner image to a sheet;

wherein the image forming portion includes:

at least one photosensitive drum rotated around a predetermined axis and having a circumference surface which allows an electrostatic latent image to be formed thereon and carrying a toner image according to the electrostatic latent image;

at least one developing device which supplies a toner to the photosensitive drum to make the electrostatic latent image appear as the toner image;

at least one toner container which houses a toner to be replenished to the developing device; and at least one drive portion;

the device main body includes:

an openable main body cover; and at least one container cover which is exposed to an outside of the device main body by opening of the main body cover and which is capable of switching between an open state of allowing attachment/detachment of the toner container to/from the device main body and a closed state of preventing removal of the toner container from the device main body; and the at least one drive portion has:

a motor rotatable in a first rotation direction and a second rotation direction reverse to the first rotation direction; and a drive transmission unit including a first drive transmission portion which transmits a rotation drive force of the motor rotating in the first rotation direction to the toner container, to transport the toner housed in the toner container in a predetermined direction, and regulates transmission of a rotation drive force of the motor rotating in the second rotation direction to the toner container, and a second drive transmission portion which transmits the rotation drive force of the motor rotating in the second rotation direction to the container cover, to cause the container cover to switch from the closed state to the open state, and regulates transmission of the rotation drive force of the motor rotating in the first rotation direction to the container cover.

2. The image forming device according to claim 1, wherein the second drive transmission portion includes:

a lock portion which is supported in the device main body so as to reciprocate and locks the container cover in the closed state; and a lock transmission portion which transmits the rotation drive force of the motor rotating in the second rotation direction to the lock portion to cause the lock portion to reciprocate, thus unlocking the container cover and causing the container cover to switch from the closed state to the open state.

3. The image forming device according to claim 2, wherein the toner container has a cylindrical shape extending in a predetermined axial direction, the motor is arranged to be opposed to one end side of the toner container in the axial direction, the container cover and the lock portion are arranged to be opposed to the other end side of the toner container in the axial direction, and the lock transmission portion includes:

at least one gear coupled to the motor;

a shaft extending along the axial direction and coupled to the lock portion; and a conversion transmission portion which converts a rotation drive force of the motor in the second rotation direction to be transmitted to the gear to slide movement in the axial direction of the shaft to cause the lock portion to reciprocate, thus allowing the container cover to be opened.

4. The image forming device according to claim 1, further comprising:

a toner detection portion which detects that an amount of a toner in the toner container has fallen below a predetermined threshold value; and a container controller which causes the motor to rotate in the second rotation direction to open the container cover when the toner detection portion detects that the amount of the toner has fallen below the threshold value.

5. The image forming device according to claim 4, further comprising:

a cover detection portion which detects that the main body cover is opened; wherein when the cover detection portion detects that the main body cover is opened and the toner detection portion detects that the amount of the toner has fallen below the threshold value, the container controller causes the motor to rotate in the second rotation direction to open the container cover.

6. The image forming device according to claim 1, wherein the at least one toner container includes a first toner container which houses a toner to be replenished to the predetermined developing device, and a second toner container arranged adjacent to the first toner container to house a toner to be replenished to the same developing device as that of the first toner container, the at least one container cover includes:

a first container cover which is capable of switching between an open state of allowing attachment/detachment of the first toner container to/from the device main body and a closed state of preventing removal of the first toner container from the device main body; and a second container cover which is capable of switching between an open state of allowing attachment/detachment of the second toner container to/from the device main body and a closed state of preventing removal of the second toner container from the device main body;

the first drive transmission portion of the drive transmission unit transmits a rotation drive force of the motor rotating in the first rotation direction to the first toner container, to transport the toner housed in the first toner container in a predetermined direction, and regulates transmission of a rotation drive force of the motor rotating in the second rotation direction to the first toner container, the second drive transmission portion of the drive transmission unit transmits the rotation drive force of the motor rotating in the second rotation direction to the first container cover, to cause the first container cover to switch from the closed state to the open state, and regulates transmission of the rotation drive force of the motor rotating in the first rotation direction to the first container cover, and the drive transmission unit further includes:

a third drive transmission portion which transmits the rotation drive force of the motor rotating in the second rotation direction to the second toner container, to transport the toner housed in the second toner container in a predetermined direction, and regulates transmission of the rotation drive force of the motor rotating in the first rotation direction to the second toner container; and a fourth drive transmission portion which transmits the rotation drive force of the motor rotating in the first rotation direction to the second container cover, to cause the second container cover to switch from the closed state to the open state, and regulates transmission of the rotation drive force of the motor rotating in the second rotation direction to the second container cover.

7. The image forming device according to claim 6, further comprising:

a container controller which controls the motor and the drive transmission unit; wherein the container controller replenishes a toner to the predetermined developing device from the first toner container or the second toner container by selectively causing the motor to rotate in the first rotation direction or the second rotation direction.

8. The image forming device according to claim 7, wherein the first drive transmission portion has a first clutch which allows transmission of the rotation drive force of the motor rotating in the first rotation direction to the first toner container, and regulates transmission of the rotation drive force of the motor rotating in the second rotation direction to the first toner container, and the third drive transmission portion has a second clutch which allows transmission of the rotation drive force of the motor rotating in the second rotation direction to the second toner container, and regulates transmission of the rotation drive force of the motor rotating in the first rotation direction to the second toner container.

9. The image forming device according to claim 7, wherein the second drive transmission portion has a third clutch which regulates transmission of the rotation drive force of the motor rotating in the first rotation direction to the first container cover, and the fourth drive transmission portion has a fourth clutch which regulates transmission of the rotation drive force of the motor rotating in the second rotation direction to the second container cover.

10. The image forming device according to claim 6, further comprising:

a first toner detection portion which detects that an amount of a toner in the first toner container has fallen below a predetermined threshold value;

a second toner detection portion which detects that an amount of a toner in the second toner container has fallen below a predetermined threshold value; and a container controller which, when the first toner detection portion detects that the amount of the toner in the first toner container has fallen below the threshold value, causes the motor to rotate in the second rotation direction to open the first container cover, and when the second toner detection portion detects that the amount of the toner in the second toner container has fallen below the threshold value, causes the motor to rotate in the first rotation direction to open the second container cover.

11. The image forming device according to claim 10, further comprising:

a cover detection portion which detects that the main body cover is opened; wherein when the cover detection portion detects that the main body cover is opened, the container controller causes the first container cover or the second container cover to be opened.

* * * * *